US008917874B2

(12) United States Patent
Oh et al.

(10) Patent No.: US 8,917,874 B2
(45) **Date of Patent: *Dec. 23, 2014**

(54) METHOD AND APPARATUS FOR DECODING AN AUDIO SIGNAL

(75) Inventors: Hyen O Oh, Gyeonggi-do (KR); Hee Suk Pang, Seoul (KR); Dong Soo Kim, Seoul (KR); Jae Hyun Lim, Seoul (KR); Yang-Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 1744 days.

This patent is subject to a terminal disclaimer.

(21) Appl. No.: 11/915,319

(22) PCT Filed: May 25, 2006

(86) PCT No.: PCT/KR2006/001987

§ 371 (c)(1),
(2), (4) Date: Sep. 24, 2008

(87) PCT Pub. No.: WO2006/126844

PCT Pub. Date: Nov. 30, 2006

(65) Prior Publication Data

US 2009/0225991 A1 Sep. 10, 2009

Related U.S. Application Data

(60) Provisional application No. 60/684,579, filed on May 26, 2005, provisional application No. 60/759,980, (Continued)

(30) Foreign Application Priority Data

Apr. 4, 2006 (KR) ..... 10-2006-0030670

(51) Int. Cl.

| | |
|---|---|
| ***H04R 5/00*** | (2006.01) |
| ***H04S 5/00*** | (2006.01) |
| ***H04S 1/00*** | (2006.01) |
| ***H04S 3/00*** | (2006.01) |
| *G10L 19/008* | (2013.01) |
| *H04R 5/04* | (2006.01) |

(52) U.S. Cl.
CPC ..... *H04S 1/007* (2013.01); *H04S 5/005* (2013.01); *H04S 5/00* (2013.01);

(Continued)

(58) Field of Classification Search
CPC ..... H04S 1/002; G10L 19/00; G10L 19/008
USPC ..... 381/17; 704/E19.001, 500
See application file for complete search history.

(56) References Cited

U.S. PATENT DOCUMENTS 5,166,685 A 11/1992 Campbell et al.
5,524,054 A 6/1996 Spille et al.

(Continued)

FOREIGN PATENT DOCUMENTS

CN 1223064 7/1999
CN 1253464 5/2000

(Continued)

OTHER PUBLICATIONS

Japanese Office Action dated Nov. 9, 2010 from Japanese Application No. 2008-551199 with English translation, 11 pages.

(Continued)

*Primary Examiner* — Fernando L Toledo
*Assistant Examiner* — Neil Prasad
(74) *Attorney, Agent, or Firm* — Fish & Richardson P.C.

(57) ABSTRACT

Method and apparatus for processing audio signals are provided. The method for decoding an audio signal includes extracting a downmix signal and spatial information from a received audio signal, generating surround converting information using the spatial information and rendering the downmix signal to generate a pseudo-surround signal in a previously set rendering domain, using the surround converting information. The apparatus for decoding an audio signal includes a demultiplexing part extracting a downmix signal and spatial information from a received audio signal, an information converting part generating surround converting information using the spatial information and a pseudo-surround generating part rendering the downmix signal to generate a pseudo-surround signal in a previously set rendering domain, using the surround converting information.

25 Claims, 9 Drawing Sheets

Related U.S. Application Data filed on Jan. 19, 2006, provisional application No. 60/776,724, filed on Feb. 27, 2006, provisional application No. 60/779,417, filed on Mar. 7, 2006, provisional application No. 60/779,441, filed on Mar. 7, 2006, provisional application No. 60/779,442, filed on Mar. 7, 2006.

(52) U.S. Cl.

CPC ..... *G10L 19/008* (2013.01); *H04R 5/04* (2013.01); *H04S 2400/01* (2013.01); *H04S 2420/01* (2013.01); *H04S 2420/03* (2013.01); *H04S 3/008* (2013.01)

USPC ..... 381/17

(56) References Cited

U.S. PATENT DOCUMENTS

| | | | | |
|---|---|---|---|---|
| 5,561,736 | A | 10/1996 | Moore et al. | |
| 5,579,396 | A | 11/1996 | Iida et al. | |
| 5,632,005 | A | 5/1997 | Davis et al. | |
| 5,668,924 | A | 9/1997 | Takahashi | |
| 5,703,584 | A | 12/1997 | Hill et al. | |
| 5,862,227 | A | 1/1999 | Orduna et al. | |
| 5,886,988 | A | 3/1999 | Yun et al. | |
| 5,890,125 | A | 3/1999 | Davis et al. | |
| 6,072,877 | A | 6/2000 | Abel | |
| 6,081,783 | A | 6/2000 | Divine et al. | |
| 6,118,875 | A | 9/2000 | Moller et al. | |
| 6,122,619 | A | 9/2000 | Kolluru et al. | |
| 6,226,616 | B1 | 5/2001 | You et al. | |
| 6,307,941 | B1 | 10/2001 | Tanner et al. | |
| 6,466,913 | B1 | 10/2002 | Yasuda et al. | |
| 6,504,496 | B1 | 1/2003 | Mesarovic et al. | |
| 6,574,339 | B1 | 6/2003 | Kim | |
| 6,611,212 | B1 | 8/2003 | Craven et al. | |
| 6,633,648 | B1 | 10/2003 | Bauck | |
| 6,711,266 | B1 | 3/2004 | Aylward et al. | |
| 6,721,425 | B1 | 4/2004 | Aylward | |
| 6,795,556 | B1 | 9/2004 | Sibbald et al. | |
| 6,973,130 | B1 | 12/2005 | Wee et al. | |
| 7,085,393 | B1 | 8/2006 | Chen | |
| 7,177,431 | B2 | 2/2007 | Davis et al. | |
| 7,180,964 | B2 | 2/2007 | Borowski et al. | |
| 7,260,540 | B2 | 8/2007 | Miyasaka et al. | |
| 7,302,068 | B2 | 11/2007 | Longbottom et al. | |
| 7,391,877 | B1 | 6/2008 | Brungart | |
| 7,519,530 | B2 | 4/2009 | Kaajas et al. | |
| 7,519,538 | B2 | 4/2009 | Villemoes et al. | |
| 7,536,021 | B2 | 5/2009 | Dickins et al. | |
| 7,555,434 | B2 | 6/2009 | Nomura et al. | |
| 7,613,306 | B2 | 11/2009 | Miyasaka et al. | |
| 7,668,712 | B2 | 2/2010 | Wang et al. | |
| 7,720,230 | B2 | 5/2010 | Allamanche et al. | |
| 7,761,304 | B2 | 7/2010 | Faller | |
| 7,773,756 | B2 | 8/2010 | Beard | |
| 7,787,631 | B2 | 8/2010 | Faller | |
| 7,797,163 | B2 | 9/2010 | Pang et al. | |
| 7,880,748 | B1 | 2/2011 | Sevigny | |
| 7,916,873 | B2 * | 3/2011 | Villemoes et al. | 381/22 |
| 7,961,889 | B2 | 6/2011 | Kim et al. | |
| 7,979,282 | B2 | 7/2011 | Kim et al. | |
| 7,987,096 | B2 | 7/2011 | Kim et al. | |
| 8,081,762 | B2 | 12/2011 | Ojala et al. | |
| 8,081,764 | B2 | 12/2011 | Takagi et al. | |
| 8,108,220 | B2 | 1/2012 | Saunders et al. | |
| 8,116,459 | B2 | 2/2012 | Disch et al. | |
| 8,150,042 | B2 | 4/2012 | Van Loon et al. | |
| 8,150,066 | B2 | 4/2012 | Kubo | |
| 8,185,403 | B2 | 5/2012 | Pang et al. | |
| 8,189,682 | B2 | 5/2012 | Yamasaki | |
| 8,255,211 | B2 | 8/2012 | Vinton et al. | |
| 8,577,686 | B2 * | 11/2013 | Oh et al. | 704/500 |
| 2001/0031062 | A1 | 10/2001 | Terai et al. | |
| 2003/0007648 | A1 | 1/2003 | Currell | |
| 2003/0035553 | A1 | 2/2003 | Baumgarte et al. | |
| 2003/0182423 | A1 | 9/2003 | Shafir et al. | |
| 2003/0236583 | A1 | 12/2003 | Baumgarte et al. | |
| 2004/0032960 | A1 | 2/2004 | Griesinger | |
| 2004/0049379 | A1 | 3/2004 | Thumpudi et al. | |
| 2004/0071445 | A1 | 4/2004 | Tarnoff et al. | |
| 2004/0111171 | A1 | 6/2004 | Jang et al. | |
| 2004/0118195 | A1 | 6/2004 | Nespo et al. | |
| 2004/0138874 | A1 | 7/2004 | Kaajas et al. | |
| 2004/0196770 | A1 | 10/2004 | Touyama et al. | |
| 2004/0196982 | A1 | 10/2004 | Aylward et al. | |
| 2005/0061808 | A1 | 3/2005 | Cole et al. | |
| 2005/0063613 | A1 | 3/2005 | Casey et al. | |
| 2005/0074127 | A1 | 4/2005 | Herre et al. | |
| 2005/0089181 | A1 | 4/2005 | Polk, Jr. | |
| 2005/0117762 | A1 | 6/2005 | Sakurai et al. | |
| 2005/0135643 | A1 | 6/2005 | Lee et al. | |
| 2005/0157883 | A1 | 7/2005 | Herre et al. | |
| 2005/0179701 | A1 | 8/2005 | Jahnke | |
| 2005/0180579 | A1 | 8/2005 | Baumgarte | |
| 2005/0195981 | A1 | 9/2005 | Faller et al. | |
| 2005/0271367 | A1 | 12/2005 | Lee et al. | |
| 2005/0273322 | A1 | 12/2005 | Lee et al. | |
| 2005/0273324 | A1 | 12/2005 | Yi | |
| 2005/0276430 | A1 | 12/2005 | He et al. | |
| 2006/0002572 | A1 | 1/2006 | Smithers et al. | |
| 2006/0004583 | A1 | 1/2006 | Herre et al. | |
| 2006/0008091 | A1 | 1/2006 | Kim et al. | |
| 2006/0008094 | A1 | 1/2006 | Huang et al. | |
| 2006/0009225 | A1 | 1/2006 | Herre et al. | |
| 2006/0050909 | A1 | 3/2006 | Kim et al. | |
| 2006/0072764 | A1 | 4/2006 | Mertens et al. | |
| 2006/0083394 | A1 | 4/2006 | McGrath | |
| 2006/0115100 | A1 | 6/2006 | Faller et al. | |
| 2006/0126851 | A1 | 6/2006 | Yuen et al. | |
| 2006/0133618 | A1 | 6/2006 | Villemoes et al. | |
| 2006/0153408 | A1 | 7/2006 | Faller et al. | |
| 2006/0190247 | A1 | 8/2006 | Lindblom | |
| 2006/0198527 | A1 | 9/2006 | Chun | |
| 2006/0233379 | A1 * | 10/2006 | Villemoes et al. | 381/23 |
| 2006/0233380 | A1 | 10/2006 | Holzer et al. | |
| 2006/0239473 | A1 | 10/2006 | Kjorling et al. | |
| 2006/0251276 | A1 | 11/2006 | Chen | |
| 2007/0133831 | A1 | 6/2007 | Kim et al. | |
| 2007/0160218 | A1 | 7/2007 | Jakka et al. | |
| 2007/0160219 | A1 | 7/2007 | Jakka et al. | |
| 2007/0162278 | A1 * | 7/2007 | Miyasaka et al. | 704/201 |
| 2007/0165886 | A1 | 7/2007 | Topliss et al. | |
| 2007/0172071 | A1 | 7/2007 | Mehrotra et al. | |
| 2007/0183603 | A1 | 8/2007 | Jin et al. | |
| 2007/0203697 | A1 | 8/2007 | Pang et al. | |
| 2007/0219808 | A1 | 9/2007 | Herre et al. | |
| 2007/0223708 | A1 | 9/2007 | Villemoes et al. | |
| 2007/0223709 | A1 | 9/2007 | Kim et al. | |
| 2007/0233296 | A1 | 10/2007 | Kim et al. | |
| 2007/0258607 | A1 | 11/2007 | Purnhagen et al. | |
| 2007/0280485 | A1 | 12/2007 | Villemoes | |
| 2007/0291950 | A1 | 12/2007 | Kimura et al. | |
| 2008/0002842 | A1 | 1/2008 | Neusinger et al. | |
| 2008/0008327 | A1 | 1/2008 | Ojala et al. | |
| 2008/0033732 | A1 | 2/2008 | Seefeldt et al. | |
| 2008/0052089 | A1 | 2/2008 | Takagi | |
| 2008/0097750 | A1 | 4/2008 | Seefeldt et al. | |
| 2008/0130904 | A1 | 6/2008 | Faller | |
| 2008/0192941 | A1 | 8/2008 | Oh et al. | |
| 2008/0195397 | A1 | 8/2008 | Myburg et al. | |
| 2008/0199026 | A1 | 8/2008 | Oh et al. | |
| 2008/0304670 | A1 | 12/2008 | Breebaart | |
| 2009/0041265 | A1 | 2/2009 | Kubo | |
| 2009/0110203 | A1 | 4/2009 | Taleb | |
| 2009/0129601 | A1 | 5/2009 | Ojala et al. | |
| 2011/0085669 | A1 | 4/2011 | Jung et al. | |

FOREIGN PATENT DOCUMENTS

| | | |
|---|---|---|
| CN | 1411679 | 4/2003 |
| CN | 1495705 | 5/2004 |
| CN | 1655651 | 8/2005 |
| EP | 0 637 191 | 2/1995 |

(56) References Cited

FOREIGN PATENT DOCUMENTS

| | | | |
|---|---|---|---|
| EP | 0857375 | | 8/1998 |
| EP | 1211857 | | 6/2002 |
| EP | 1 315 148 | | 5/2003 |
| EP | 1376538 | A1 | 1/2004 |
| EP | 1455345 | | 9/2004 |
| EP | 1 545 154 | | 6/2005 |
| EP | 0956668 | | 11/2005 |
| EP | 1 617 413 | | 1/2006 |
| JP | 7248255 | | 9/1995 |
| JP | 08-079900 | | 3/1996 |
| JP | 8-084400 | | 3/1996 |
| JP | 9-074446 | | 3/1997 |
| JP | 09-224300 | | 8/1997 |
| JP | 9-261351 | | 10/1997 |
| JP | 09-275544 | | 10/1997 |
| JP | 10-304498 | | 11/1998 |
| JP | 11-032400 | | 2/1999 |
| JP | 11503882 | | 3/1999 |
| JP | 2001028800 | | 1/2001 |
| JP | 2001-188578 | | 7/2001 |
| JP | 2001-516537 | | 9/2001 |
| JP | 2001-359197 | | 12/2001 |
| JP | 2002-049399 | | 2/2002 |
| JP | 2003-009296 | | 1/2003 |
| JP | 2003-111198 | | 4/2003 |
| JP | 2004-078183 | | 3/2004 |
| JP | 2004-535145 | | 11/2004 |
| JP | 2005-063097 | | 3/2005 |
| JP | 2005-229612 | | 8/2005 |
| JP | 2005-523624 | | 8/2005 |
| JP | 2005-352396 | | 12/2005 |
| JP | 2006-014219 | | 1/2006 |
| JP | 2007-511140 | | 4/2007 |
| JP | 2007-288900 | | 11/2007 |
| JP | 2008-504578 | | 2/2008 |
| JP | 08-065169 | | 3/2008 |
| JP | 2008-511044 | | 4/2008 |
| JP | 08-202397 | | 9/2008 |
| KR | 10-2001-0001993 | | 1/2001 |
| KR | 10-2001-0009258 | | 2/2001 |
| KR | 2004106321 | A | 12/2004 |
| KR | 2005061808 | A | 6/2005 |
| KR | 2005063613 | A | 6/2005 |
| RU | 2119259 | | 9/1998 |
| RU | 2129336 | | 4/1999 |
| RU | 2221329 | C2 | 1/2004 |
| RU | 2004133032 | | 4/2005 |
| RU | 2005103637 | A | 7/2005 |
| RU | 2005104123 | | 7/2005 |
| TW | 263646 | | 11/1995 |
| TW | 289885 | | 11/1996 |
| TW | 408304 | | 10/2000 |
| TW | 503626 | | 9/2001 |
| TW | 468182 | | 12/2001 |
| TW | 480894 | | 3/2002 |
| TW | 550541 | | 9/2003 |
| TW | 200304120 | | 9/2003 |
| TW | 200405673 | | 4/2004 |
| TW | 594675 | | 6/2004 |
| TW | I230024 | | 3/2005 |
| TW | 200921644 | | 5/2005 |
| TW | 2005334234 | | 10/2005 |
| TW | 200537436 | A | 11/2005 |
| TW | 200603653 | | 1/2006 |
| WO | 97/15983 | | 5/1997 |
| WO | WO 98/42162 | | 9/1998 |
| WO | 99/49574 | | 9/1999 |
| WO | 9949574 | | 9/1999 |
| WO | WO 03/007656 | | 1/2003 |
| WO | WO 03-007656 | | 1/2003 |
| WO | 03/085643 | | 10/2003 |
| WO | 03-090208 | | 10/2003 |
| WO | 2004-008805 | | 1/2004 |
| WO | 2004/008806 | | 1/2004 |
| WO | 2004-019656 | | 3/2004 |
| WO | 2004/028204 | | 4/2004 |
| WO | 2004-036549 | | 4/2004 |
| WO | 2004-036954 | | 4/2004 |
| WO | 2004-036955 | | 4/2004 |
| WO | 2004036548 | | 4/2004 |
| WO | 2005/036925 | | 4/2005 |
| WO | 2005/043511 | | 5/2005 |
| WO | 2005/069637 | | 7/2005 |
| WO | 2005/069638 | | 7/2005 |
| WO | 2005/081229 | | 9/2005 |
| WO | 2005/098826 | | 10/2005 |
| WO | 2005/101371 | | 10/2005 |
| WO | WO2005101370 | A1 | 10/2005 |
| WO | 2006/002748 | | 1/2006 |
| WO | WO 2006-003813 | | 1/2006 |
| WO | WO 2007/068243 | | 6/2007 |
| WO | 2007/080212 | | 7/2007 |

OTHER PUBLICATIONS

Japanese Office Action dated Nov. 9, 2010 from Japanese Application No. 2008-551194 with English translation, 11 pages.

Japanese Office Action dated Nov. 9, 2010 from Japanese Application No. 2008-551193 with English translation, 11 pages.

Japanese Office Action dated Nov. 9, 2010 from Japanese Application No. 2008-551200 with English translation, 11 pages.

Korean Office Action dated Nov. 25, 2010 from Korean Application No. 10-2008-7016481 with English translation, 8 pages.

MPEG-2 Standard. ISO/IEC Document 13818-3:1994(E), Generic Coding of Moving Pictures and Associated Audio information, Part 3: Audio, Nov. 11, 1994, 4 pages.

Chang, "Document Register for 75th meeting in Bangkok, Thailand", ISO/IEC JTC/SC29/WG11, MPEG2005/M12715, Bangkok, Thailand, Jan. 2006, 3 pages.

Donnelly et al., "The Fast Fourier Transform for Experimentalists, Part II: Convolutions," Computing in Science & Engineering, IEEE, Aug. 1, 2005, vol. 7, No. 4, pp. 92-95.

Office Action, U.S. Appl. No. 12/161,560, dated Oct. 27, 2011, 14 pages.

Office Action, U.S. Appl. No. 12/278,775, dated Dec. 9, 2011, 16 pages.

Office Action, European Appln. No. 07 701 033.8, dated Dec. 16, 2011, 4 pages.

Office Action, U.S. Appl. No. 12/278,569, dated Dec. 2, 2011, 10 pages.

Notice of Allowance, U.S. Appl. No. 12/278,572, dated Dec. 20, 2011, 12 pages.

Notice of Allowance, U.S. Appl. No. 12/161,334, dated Dec. 20, 2011, 11 pages.

Herre et al., "MP3 Surround: Efficient and Compatible Coding of Multi-Channel Audio," Convention Paper of the Audio Engineering Society 116th Convention, Berlin, Germany, May 8, 2004, 6049, pp. 1-14.

Office Action, Japanese Appln. No. 2008-554134, dated Nov. 15, 2011, 6 pages with English translation.

Office Action, Japanese Appln. No. 2008-554141, dated Nov. 24, 2011, 8 pages with English translation.

Office Action, Japanese Appln. No. 2008-554139, dated Nov. 16, 2011, 12 pages with English translation.

Office Action, Japanese Appln. No. 2008-554138, dated Nov. 22, 2011, 7 pages with English translation.

Quackenbush, "Annex I—Audio report" ISO/IEC JTC1/SC29/WG11, MPEG, N7757, Moving Picture Experts Group, Bangkok, Thailand, Jan. 2006, pp. 168-196.

"Text of ISO/IEC 14496-3:2001/FPDAM 4, Audio Lossless Coding (ALS), New Audio Profiles and BSAC Extensions," International Organization for Standardization, ISO/IEC JTC1/SC29/WG11, No. N7016, Hong Kong, China, Jan. 2005, 65 pages.

Search Report, European Appln. No. 07708824.3, dated Dec. 15, 2010, 7 pages.

Faller, C. et al., "Efficient Representation of Spatial Audio Using Perceptual Parametrization," Workshop on Applications of Signal Processing to Audio and Acoustics, Oct. 21-24, 2001, Piscataway, NJ, USA, IEEE, pp. 199-202.

(56) References Cited

OTHER PUBLICATIONS

Office Action, Japanese Appln. No. 2008-551195, dated Dec. 21, 2010, 10 pages with English translation.
Office Action, U.S. Appl. No. 12/161,563, dated Jan. 18, 2012, 39 pages.
Office Action, U.S Appl. No. 12/161,337, dated Jan. 9, 2012, 4 pages.
Office Action, U.S. Appl. No. 12/278,774, dated Jan. 20, 2012, 44 pages.
"Text of ISO/IEC 23003-1:2006/FCD, MPEG Surround," International Organization for Standardization Organisation Internationale De Normalisation, ISO/IEC JTC 1/SC 29/WG 11 Coding of Moving Pictures and Audio, No. N7947, Audio sub-group, Jan. 2006, Bangkok, Thailand, pp. 1-178.
Pasi, Ojala, "New use cases for spatial audio coding," ITU Study Group 16—Video Coding Experts Group—ISO/IEG MPEG & ITU-T VCEG (ISO/IEC JTC1/SC29/WG11 and ITU-T SG16 Q6), XX, XX, No. M12913; XP030041582 (Jan. 11, 2006).
Pasi, Ojala et al., "Further information on 1-26 Nokia binaural decoder," ITU Study Group 16—Video Coding Experts Group—ISO/IEC MPEG & ITU-T VCEG (ISO/IEC JTC1/SC29/WG11 and ITU-T SG16 Q6), XX, XX, No. M13231; XP030041900 (Mar. 29, 2006).
Kristofer, Kjorling, "Proposal for extended signaling in spatial audio," ITU Study Group 16—Video Coding Experts Group—ISO/IEC MPEG & ITU-T VCEG (ISO/IEC JTC1/SC29/WG11 and ITU-T SG16 Q6), XX, XX, No. M12361; XP030041045 (Jul. 20, 2005).
WD 2 for MPEG Surround, ITU Study Group 16—Video Coding Experts Group—ISO/IEC MPEG & ITU-T VCEG (ISO/IEC JTC1/SC29/WG11 and ITU-T SG16 Q6), XX, XX, No. N7387; XP030013965 (Jul. 29, 2005).
EPO Examiner, European Search Report for Application No. 06 747 458.5 dated Feb. 4, 2011.
EPO Examiner, European Search Report for Application No. 06 747 459.3 dated Feb. 4, 2011.
Korean Office Action for KR Application No. 10-2008-7016477, dated Mar. 26, 2010, 12 pages.
Korean Office Action for KR Application No. 10-2008-7016479, dated Mar. 26, 2010, 11 pages.
Taiwanese Office Action for TW Application No. 96104543, dated Mar. 30, 2010, 12, pages.
Kulkarni et al., "On the Minimum-Phase Approximation of Head-Related Transfer Functions," Applications of Signal Processing to Audio and Acoustics, IEEE ASSP Workshop on New Paltz, Oct. 15-18, 1995, 4 pages.
"ISO/IEC 23003-1:2006/FCD, MPEG Surround," ITU Study Group 16, Video Coding Experts Group—ISO/IEC MPEG & ITU-T VCEG (ISO/IEC/JTC1/SC29/WG11 and ITU-T SG16 Q6), XX, XX, No. N7947, Mar. 3, 2006, 186 pages.
Search Report, European Appln. No. 07701037.9, dated Jun. 15, 2011, 8 pages.
Chinese Office Action issued in Appln No. 200780004505.3 on Mar. 2, 2011, 14 pages, including English translation.
Final Office Action, U.S. Appl. No. 11/915,329, dated Mar. 24, 2011, 14 pages.
Hironori Tokuno. Et al. 'Inverse Filter of Sound Reproduction Systems Using Regularization', IEICE Trans. Fundamentals. vol. E80-A.No. 5.May 1997, pp. 809-820.
Korean Office Action for Appln. No. 10-2008-7016477 dated Mar. 26, 2010, 4 pages.
Korean Office Action for Appln. No. 10-2008-7016478 dated Mar. 26, 2010, 4 pages.
Korean Office Action for Appln. No. 10-2008-7016479 dated Mar. 26, 2010, 4 pages.
Taiwanese Office Action for Appln. No. 096102406 dated Mar. 4, 2010, 7 pages.
Japanese Office Action for Application No. 2008-513378, dated Dec. 14, 2009, 12 pages.
Taiwan Examiner, Taiwanese Office Action for Application No. 096102407, dated Dec. 10, 2009, 8 pages.
Breebaart, et al.: "Multi-Channel Goes Mobile: MPEG Surround Binaural Rendering" In: Audio Engineering Society the 29th International Conference, Seoul, Sep. 2-4, 2006, pp. 1-13. See the abstract, pp. 1-4, figures 5,6.
Breebaart, J., et al.: "MPEG Spatial Audio Coding/MPEG Surround: Overview and Current Status" In: Audio Engineering Society the 119th Convention, New York, Oct. 7-10, 2005, pp. 1-17. See pp. 4-6.
Faller, C., et al.: "Binaural Cue Coding—Part II: Schemes and Applications", IEEE Transactions on Speech and Audio Processing, vol. 11, No. 6, 2003, 12 pages.
Faller, C.: "Coding of Spatial Audio Compatible with Different Playback Formats", Audio Engineering Society Convention Paper, Presented at 117th Convention, Oct. 28-31, 2004, San Francisco, CA.
Faller, C.: "Parametric Coding of Spatial Audio", Proc. of the 7th Int. Conference on Digital Audio Effects, Naples, Italy, 2004, 6 pages.
Herre, J., et al.: "Spatial Audio Coding: Next generation efficient and compatible coding of multi-channel audio", Audio Engineering Society Convention Paper, San Francisco, CA , 2004, 13 pages.
Herre, J., et al.: "The Reference Model Architecture for MPEG Spatial Audio Coding", Audio Engineering Society Convention Paper 6447, 2005, Barcelona, Spain, 13 pages.
International Search Report in International Application No. PCT/KR2006/000345, dated Apr. 19, 2007, 1 page.
International Search Report in International Application No. PCT/KR2006/000346, dated Apr. 18, 2007, 1 page.
International Search Report in International Application No. PCT/KR2006/000347, dated Apr. 17, 2007, 1 page.
International Search Report in International Application No. PCT/KR2006/000866, dated Apr. 30, 2007, 1 page.
International Search Report in International Application No. PCT/KR2006/000867, dated Apr. 30, 2007, 1 page.
International Search Report in International Application No. PCT/KR2006/000868, dated Apr. 30, 2007, 1 page.
International Search Report in International Application No. PCT/KR2006/001987, dated Nov. 24, 2006, 2 pages.
International Search Report in International Application No. PCT/KR2006/002016, dated Oct. 16, 2006, 2 pages.
International Search Report in International Application No. PCT/KR2006/003659, dated Jan. 9, 2007, 1 page.
International Search Report in International Application No. PCT/KR2006/003661, dated Jan. 11, 2007, 1 page.
International Search Report in International Application No. PCT/KR2007/000340, dated May 4, 2007, 1 page.
International Search Report in International Application No. PCT/KR2007/000668, dated Jun. 11, 2007, 2 pages.
International Search Report in International Application No. PCT/KR2007/000672, dated Jun. 11, 2007, 1 page.
International Search Report in International Application No. PCT/KR2007/000675, dated Jun. 8, 2007, 1 page.
International Search Report in International Application No. PCT/KR2007/000676, dated Jun. 8, 2007, 1 page.
International Search Report in International Application No. PCT/KR2007/000730, dated Jun. 12, 2007, 1 page.
International Search Report in International Application No. PCT/KR2007/001560, dated Jul. 20, 2007, 1 page.
International Search Report in International Application No. PCT/KR2007/001602, dated Jul. 23, 2007, 1 page.
Scheirer, E. D., et al.: "AudioBIFS: Describing Audio Scenes with the MPEG-4 Multimedia Standard", IEEE Transactions on Multimedia, Sep. 1999, vol. 1, No. 3, pp. 237-250. See the abstract.
Vannanen, R., et al.: "Encoding and Rendering of Perceptual Sound Scenes in the Carrouso Project", AES 22nd International Conference on Virtual, Synthetic and Entertainment Audio, Paris, France, 9 pages.
Vannanen, Riitta, "User Interaction and Authoring of 3D Sound Scenes in the Carrouso EU project", Audio Engineering Society Convention Paper 5764, Amsterdam, The Netherlands, 2003, 9 pages.
Office Action, Japanese Appln. No. 2008-551196, dated Dec. 21, 2010, 4 pages with English translation.
Russian Notice of Allowance for Application No. 2008133995 dated Feb. 11, 2010, 11 pages.

(56) References Cited

OTHER PUBLICATIONS

Faller, C. et al., "Binaural Cue Coding—Part II: Schemes and Applications", Nov. 2003, 1 page.
Faller, C., "Parametric Coding of Spatial Audio", Oct. 2004, 6 pages.
International Search Report in corresponding PCT application #PCT/KR2006/001987, dated Nov. 24, 2006, 3 pages.
Notice of Allowance (English language translation) from RU 2008136007 dated Jun. 8, 2010, 5 pages.
Office Action, Japanese Appln. No. 2008-513374, mailed Aug. 24, 2010, 8 pages with English translation.
Faller, "Coding of Spatial Audio Compatible with Different Playback Formats," Proceedings of the Audio Engineering Society Convention Paper, USA, Audio Engineering Society, Oct. 28, 2004, 117th Convention, pp. 1-12.
Schuijers et al., "Advances in Parametric Coding for High-Quality Audio," Proceedings of the Audio Engineering Society Convention Paper 5852, Audio Engineering Society, Mar. 22, 2003, 114th Convention, pp. 1-11.
Chinese Patent Gazette, Chinese Appln. No. 200780001540.X, mailed Jun. 15, 2011, 2 pages with English abstract.
Engdegärd et al. "Synthetic Ambience in Parametric Stereo Coding," Audio Engineering Society (AES) 116th Convention, Berlin, Germany, May 8-11, 2004, pp. 1-12.
Search Report, European Appln. No. 07708534.8, dated Jul. 4, 2011, 7 pages.
Chinese Gazette, Chinese Appln. No. 200680018245.0, dated Jul. 27, 2011, 3 pages with English abstract.
Notice of Allowance, Japanese Appln. No. 2008-551193, dated Jul. 20, 2011, 6 pages with English translation.
Russian Notice of Allowance for Application No. 2008114388, dated Aug. 24, 2009, 13 pages.
Taiwan Examiner, Taiwanese Office Action for Application No. 96104544, dated Oct. 9, 2009, 13 pages.
International Search Report for PCT Application No. PCT/KR2007/000342, dated Apr. 20, 2007, 3 pages.
European Search Report for Application No. 07 708 820.1 dated Apr. 9, 2010, 8 pages.
European Search Report for Application No. 07 708 818.5 dated Apr. 15, 2010, 7 pages.
Breebaart et al., "MPEG Surround Binaural Coding Proposal Philips/CT/ThG/VAST Audio," ITU Study Group 16—Video Coding Experts Group—ISO/IEC MPEG & ITU-T VCEG (ISO/IEC JTC1/SC29/WG11 and ITU-T SG16 Q6), XX, XX, No. M13253, Mar. 29, 2006, 49 pages.
Office Action, U.S. Appl. No. 11/915,327, dated Apr. 8, 2011, 14 pages.
Search Report, European Appln. No. 07701033.8, dated Apr. 1, 2011, 7 pages.
Kjörling et al., "MPEG Surround Amendment Work Item on Complexity Reductions of Binaural Filtering," ITU Study Group 16 Video Coding Experts Group—ISO/IEC MPEG & ITU-T VCEG (ISO/IEC JTC1/SC29/WG11 and ITU-T SG16 Q6), XX, XX, No. M13672, Jul. 12, 2006, 5 pages.
Kok Seng et al., "Core Experiment on Adding 3D Stereo Support to MPEG Surround," ITU Study Group 16 Video Coding Experts Group—ISO/IEC MPEG & ITU-T VCEG (ISO/IEC JTC1/SC29/WG11 and ITU-T SG16 Q6), XX, XX, No. M12845, Jan. 11, 2006, 11 pages.
"Text of ISO/IEC 14496-3:200X/PDAM 4, MPEG Surround," ITU Study Group 16 Video Coding Experts Group—ISO/IEC MPEG & ITU-T VCEG (ISO/IEC JTC1/SC29/WG11 and ITU-T SG16 Q6), XX, XX, No. N7530, Oct. 21, 2005, 169 pages.
European Search Report, EP Application No. 07 708 825.0, mailed May 26, 2010, 8 pages.
Schroeder, E. F. et al., "Der MPEG-2-Standard: Generische Codierung fur Bewegtbilder und zugehörige Audio-Information, Audio-Codierung (Teil 4)," Fkt Fernseh Und Kinotechnik, Fachverlag Schiele & Schon Gmbh., Berlin, DE, vol. 47, No. 7-8, Aug. 30, 1994, pp. 364-368 and 370.
Taiwan Patent Office, Office Action in Taiwanese patent application 096102410, dated Jul. 2, 2009, 5 pages.
Office Action, Canadian Application No. 2,636,494, mailed Aug. 4, 2010, 3 pages.
Office Action, U.S. Appl. No. 11/915,327, dated Dec. 10, 2010, 20 pages.
U.S. Appl. No. 11/915,329, mailed Oct. 8, 2010, 13 pages.
Moon et al., "A Multichannel Audio Compression Method with Virtual Source Location Information for MPEG-4 SAC," IEEE Trans. Consum. Electron., vol. 51, No. 4, Nov. 2005, pp. 1253-1259.
Office Action, U.S. Appl. No. 12/161,560, dated Feb. 17, 2012, 13 pages.
Savioja, "Modeling Techniques for Virtual Acoustics," Thesis, Aug. 24, 2000, 88 pages.
U.S. Office Action dated Mar. 15, 2012 for U.S. Appl. No. 12/161,558, 4 pages.
European Office Action dated Apr. 2, 2012 for Application No. 06 747 458.5, 4 pages.
Beack S; et al.; "An Efficient Representation Method for ICLD with Robustness to Spectral Distortion", IETRI Journal, vol. 27, No. 3, Jun. 2005, Electronics and Telecommunications Research Institute, KR, Jun. 1, 2005, XP003008889, 4 pages.
U.S. Office Action in U.S. Appl. No. 12/161,560, dated Oct. 3, 2013, 12 pages.
Notice of Allowance in U.S. Appl. No. 11/915,327, mailed Apr. 17, 2013, 13 pages.
Office Action, U.S. Appl. No. 12/161,563, dated Apr. 16, 2012, 11 pages.
Office Action, U.S. Appl. No. 12/278,775, dated Jun. 11, 2012, 13 pages.
Office Action, U.S. Appl. No. 12/278,774, dated Jun. 18, 2012, 12 pages.
Quackenbush, MPEG Audio Subgroup, Panasonic Presentation, Annex 1—Audio Report, 75$^{th}$ meeting, Bangkok, Thailand, Jan. 16-20, 2006, pp. 168-196.
Office Action, U.S. Appl. No. 12/278,568, dated Jul. 6, 2012, 14 pages.
Notice of Allowance in U.S. Appl. No. 12/278,774, mailed Dec. 6, 2013, 12 pages.
Notice of Allowance in U.S. Appl. No. 12/161,563, dated Sep. 28, 2012, 10 pages.
U.S. Office Action in U.S. Appl. No. 11/915,327, dated Dec. 12, 2012, 16 pages.
U.S. Office Action in U.S. Appl. No. 12/161,560, dated Feb. 21, 2014, 14 pages.
Office Action in U.S. Appl. No. 11/915,329, dated Jan. 14, 2013, 11 pages.
Notice of Allowance, U.S. Appl. No. 12/161,558, dated Aug. 10, 2012, 9 pages.
Notice of Allowance in U.S. Appl. No. 14/165,540, Jul. 2, 2014, 10 pages.

* cited by examiner

METHOD AND APPARATUS FOR DECODING AN AUDIO SIGNAL

TECHNICAL FIELD

The present invention relates to an audio signal process, and more particularly, to method and apparatus for processing audio signals, which are capable of generating pseudo-surround signals.

BACKGROUND ART

Recently, various technologies and methods for coding digital audio signal have been developing, and products related thereto are also being manufactured. Also, there have been developed methods in which audio signals having multi-channels are encoded using a psycho-acoustic model.

The psycho-acoustic model is a method to efficiently reduce amount of data as signals, which are not necessary in an encoding process, are removed, using a principle of human being's sound recognition manner. For example, human ears cannot recognize quiet sound immediately after loud sound, and also can hear only sound whose frequency is between 20~20,000 Hz.

Although the above conventional technologies and methods have been developed, there is no method known for processing an audio signal to generate a pseudo-surround signal from audio bitstream including spatial information.

DISCLOSURE OF INVENTION

The present invention provides method and apparatus for decoding audio signals, which are capable of providing pseudo-surround effect in an audio system, and data structure thereof.

According to an aspect of the present invention, there is provided a method for decoding an audio signal, the method including extracting a downmix signal and spatial information from a received audio signal, generating surround converting information using the spatial information and rendering the downmix signal to generate a pseudo-surround signal in a previously set rendering domain, using the surround converting information.

According to another aspect of the present invention, there is provided an apparatus for decoding an audio signal, the apparatus including a demultiplexing part extracting a downmix signal and spatial information from a received audio signal, an information converting part generating surround converting information using the spatial information and a pseudo-surround generating part rendering the downmix signal to generate a pseudo-surround signal in a previously set rendering domain, using the surround converting information.

According to a still another aspect of the present invention, there is provided a data structure of an audio signal, the data structure including a downmix signal which is generated by downmixing the audio signal having a plurality of channels and spatial information which is generated while the downmix signal is generated, wherein the spatial information is converted to surround converting information, and the downmix signal is rendered to be converted to a pseudo-surround signal with the surround converting information being used, in a previously set rendering domain.

According to a further aspect of the present invention, there is provided A medium storing audio signals and having a data structure, wherein the data structure comprises a downmix signal which is generated by downmixing the audio signal having a plurality of channels and spatial information which is generated while the downmix signal is generated, wherein the spatial information is converted to surround converting information, and the downmix signal is rendered to be converted to a pseudo-surround signal with the surround converting information being used, in a previously set rendering domain.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 8 illustrates a schematic view for describing filter coefficients by channels, according to an embodiment of the present invention, through.

BEST MODE FOR CARRYING OUT THE INVENTION

Reference will now be made in detail to the embodiments of the present invention, examples of which are illustrated in the accompanying drawings.

Firstly, the present invention is described by terminologies, which have been generally used in the technology related thereto. However, some terminologies are defined in the present invention to clearly describe the present invention. Therefore, the present invention must be understood based on the terminologies defined in the following description.

"Spatial information" in the present invention is indicative of information required to generate multi-channels by upmixing downmixed signal. Although the present invention will be described assuming that the spatial information is spatial parameters, it will be easily appreciated that the spatial information is not limited by the spatial parameters. Here, the spatial parameters include a Channel Level Differences (CLDs), Inter-Channel Coherences (ICCs), and Channel Prediction Coefficients (CPCs), etc. The Channel Level Difference (CLD) is indicative of an energy difference between two channels. The Inter-Channel Coherence (ICC) is indicative of cross-correlation between two channels. The Channel Prediction Coefficient (CPC) is indicative of a prediction coefficient to predict three channels from two channels.

"Core codec" in the present invention is indicative of a codec for coding an audio signal. The Core codec does not code spatial information. The present invention will be described assuming that a downmix audio signal is an audio signal coded by the Core codec. Also, the core codec may include Moving Picture Experts Group (MPEG) Layer-II, MPEG Audio Layer-III (MP3), AC-3, Ogg Vorbis, DTS, Window Media Audio (WMA), Advanced Audio Coding (AAC) or High-Efficiency AAC (HE-AAC). However, the core codec may not be provided. In this case, an uncompressed PCM signals is used. The codec may be conventional codecs and future codecs, which will be developed in the future.

"Channel splitting part" is indicative of a splitting part which can divide a particular number of input channels into another particular number of output channels, in which the output channel numbers are different from those of the input channels. The channel splitting part includes a two to three (TTT) box, which converts the two input channels to three output channels. Also, the channel splitting part includes a one to two (OTT) box, which converts the one input channel to two output channels. The channel splitting part of the present invention is not limited by the TTT and OTT boxes, rather it will be easily appreciated that the channel splitting part may be used in systems whose input channel number and output channel number are arbitrary.

Figure 1:
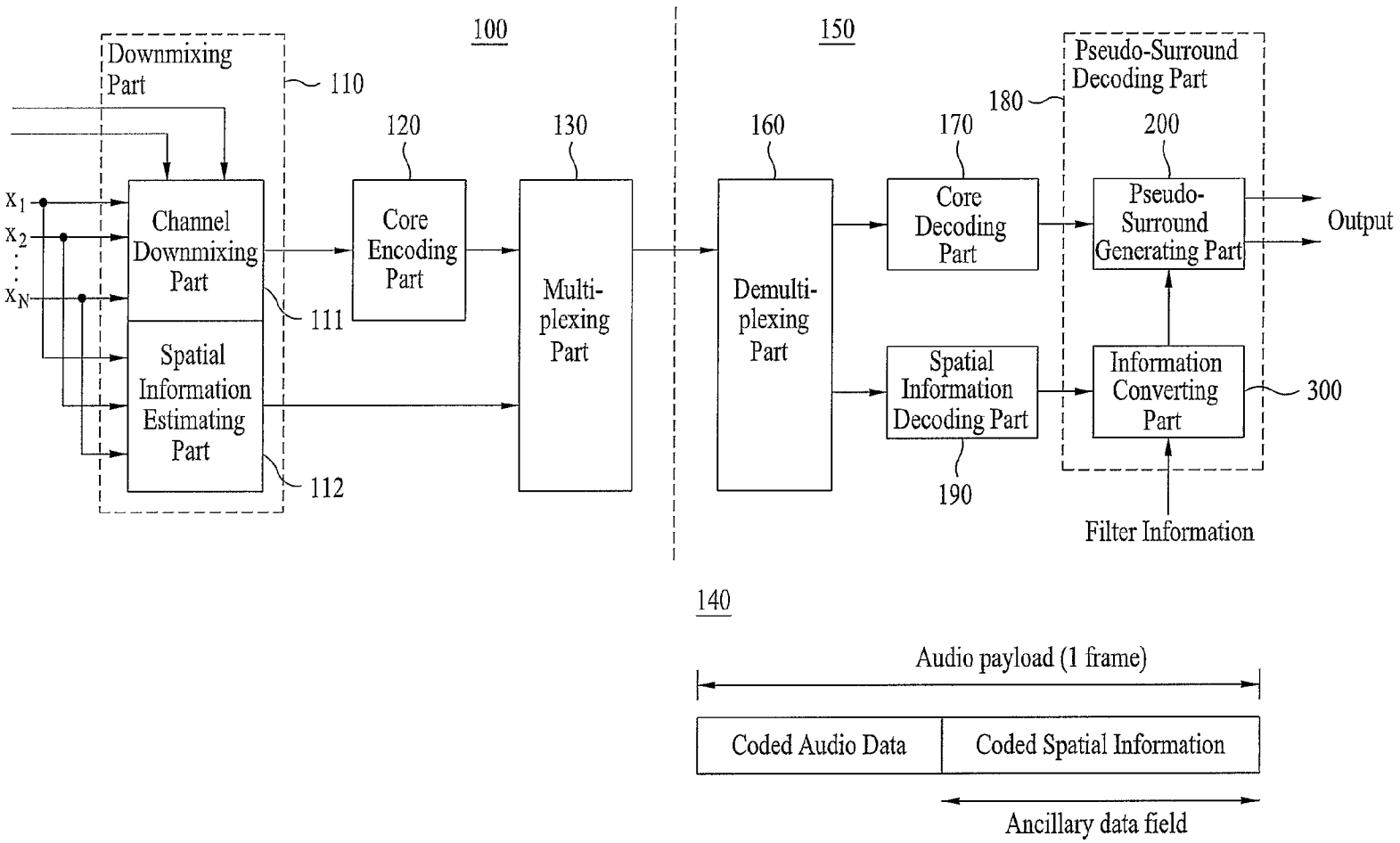
FIG. 1 illustrates a signal processing system according to an embodiment of the present invention.

FIG. 1 illustrates a signal processing system according to an embodiment of the present invention. As shown in FIG. 1, the signal processing system includes an encoding device 100 and a decoding device 150. Although the present invention will be described on the basis of the audio signal, it will be easily appreciated that the signal processing system of the present invention can process all signals as well as the audio signal.

The encoding device 100 includes a downmixing part 110, a core encoding part 120, and a multiplexing part 130. The downmixing part 110 includes a channel downmixing part 111 and a spatial information estimating part 112.

When the N multi-channel audio signals $X_1, X_2, \ldots, X_N$ are inputted the downmixing part 110 generates audio signals, depending on a certain downmixing method or an arbitrary downmix method. Here, the number of the audio signals outputted from the downmixing part 110 to the core encoding part 120 is less than the number "N" of the input multi-channel audio signals. The spatial information estimating part 112 extracts spatial information from the input multi-channel audio signals, and then transmits the extracted spatial information to the multiplexing part 130. Here, the number of the downmix channel may one or two, or be a particular number according to downmix commands. The number of the downmix channels may be set. Also, an arbitrary downmix signal is optionally used as the downmix audio signal.

The core encoding part 120 encodes the downmix audio signal which is transmitted through the downmix channel. The encoded downmix audio signal is inputted to the multiplexing part 130.

The multiplexing part 130 multiplexes the encoded downmix audio signal and the spatial information to generate a bitstream, and then transmits the generated a bitstream to the decoding device 150. Here, the bitstream may include a core codec bitstream and a spatial information bitstream.

The decoding device 150 includes a demultiplexing part 160, a core decoding part 170, and a pseudo-surround decoding part 180. The pseudo-surround decoding part 180 may include a pseudo surround generating part 200 and an information converting part 300. Also, the decoding device 150 may further include a spatial information decoding part 190. The demultiplexing part 160 receives the bitstream and demultiplexes the received bitstream to a core codec bitstream and a spatial information bitstream. The demultiplexing part 160 extracts a downmix signal and spatial information from the received bitstream.

The core decoding part 170 receives the core codec bitstream from the demultiplexing part 160 to decode the received bitstream, and then outputs the decoding result as the decoded downmix signals to the pseudo-surround decoding part 180. For example, when the encoding device 100 downmixes a multi-channel signal to be a mono-channel signal or a stereo-channel signal, the decoded downmix signal may be the mono-channel signal or the stereo-channel signal. Although the embodiment of the present invention is described on the basis of a mono-channel or a stereo-channel used as a downmix channel, it will easily appreciated that the present invention is not limited by the number of downmix channels.

The spatial information decoding part 190 receives the spatial information bitstream from the demultiplexing part 160, decodes the spatial information bitstream, and output the decoding result as the spatial information.

The pseudo-surround decoding part 180 serves to generate a pseudo-surround signal from the downmix signal using the spatial information. The following is a description for the pseudo-surround generating part 200 and the information converting part 300, which are included in the pseudo-surround decoding part 180.

The information converting part 300 receives spatial information and filter information. Also, the information converting part 300 generates surround converting information using the spatial information and the filter information. Here, the generated surround converting information has the pattern which is fit to generate the pseudo-surround signal. The surround converting information is indicative of a filter coefficient in a case that the pseudo-surround generating part 200 is a particular filter. Although the present invention is described on the basis of the filter coefficient used as the surround converting information, it will be easily appreciated that the surround converting information is not limited by the filter coefficient. Also, although the filter information is assumed to be head-related transfer function (HRTF), it will be easily appreciated that the filter information is not limited by the HRTF.

In the present invention, the above-described filter coefficient is indicative of the coefficient of the particular filter. For example, the filter coefficient may be defined as follows. A proto-type HRTF filter coefficient is indicative of an original filter coefficient of a particular HRTF filter, and may be expressed as GL_L, etc. A converted HRTF filter coefficient is indicative of a filter coefficient converted from the proto-type HRTF filter coefficient, and may be expressed as GL_L', etc. A spatialized HRTF filter coefficient is a filter coefficient obtained by spatializing the proto-type HRTF filter coefficient to generate a pseudo-surround signal, and may be expressed as FL_L1, etc. A master rendering coefficient is indicative of a filter coefficient which is necessary to perform rendering, and may be expressed as HL_L, etc. An interpolated master rendering coefficient is indicative of a filter coefficient obtained by interpolating and/or blurring the master rendering coefficient, and may be expressed as HL_L', etc. According to the present invention, it will be easily appreciated that filter coefficients do not limit by the above filter coefficients.

The pseudo-surround generating part 200 receives the decoded downmix signal from the core decoding part 170, and the surround converting information from the information converting part 300, and generates a pseudo-surround signal, using the decoded downmix signal and the surround converting information. For example, the pseudo-surround signal serves to provide a virtual multi-channel (or surround) sound in a stereo audio system. According to the present invention, it will be easily appreciated that the pseudo-surround signal will play the above role in any devices as well as in the stereo audio system. The pseudo-surround generating part 200 may perform various types of rendering according to setting modes.

It is assumed that the encoding device 100 transmits a monophonic or stereo downmix signal instead of the multi-channel audio signal, and that the downmix signal is transmitted together with spatial information of the multi-channel audio signal. In this case, the decoding device 150 including the pseudo-surround decoding part 180 may provide the effect that users have a virtual stereophonic listening experience, although the output channel of the device 150 is a stereo channel instead of a multi-channel.

The following is a description for an audio signal structure 140 according to an embodiment of the present invention, as shown in FIG. 1. When the audio signal is transmitted on the basis of a payload, it may be received through each channel or a single channel. An audio payload of 1 frame is composed of a coded audio data field and an ancillary data field. Here, the ancillary data field may include coded spatial information. For example, if a data rate of an audio payload is at 48~128 kbps, the data rate of spatial information may be at 5~32 kbps. Such an example will not limit the scope of the present invention.

Figure 2:
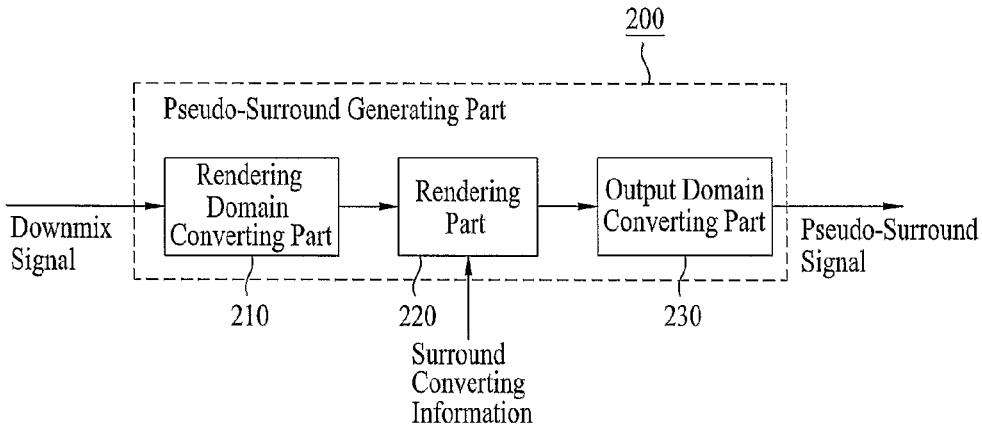
FIG. 2 illustrates a schematic block diagram of a pseudo-surround generating part according to an embodiment of the present invention.

FIG. 2 illustrates a schematic block diagram of a pseudo-surround generating part 200 according to an embodiment of the present invention.

Domains described in the present invention include a downmix domain in which a downmix signal is decoded, a spatial information domain in which spatial information is processed to generate surround converting information, a rendering domain in which a downmix signal undergoes rendering using spatial information, and an output domain in which a pseudo-surround signal of time domain is output. Here, the output domain audio signal can be heard by humans. The output domain means a time domain. The pseudo-surround generating part 200 includes a rendering part 220 and an output domain converting part 230. Also, the pseudo-surround generating part 200 may further include a rendering domain converting part 210 which converts a downmix domain into a rendering domain when the downmix domain is different from the rendering domain.

The following is a description of the three domain conversions methods, respectively, performed by three domain converting parts included in the rendering domain converting part 210. Firstly, although the following embodiment is described assuming that the rendering domain is set as a subband domain, it will be easily appreciated that the rendering domain may be set as any domain. According to a first domain conversion method, a time domain is converted to the rendering domain in case that the downmix domain is the time domain. According to a second domain conversion method, a discrete frequency domain is converted to the rendering domain in case that the downmix domain is the discrete frequency domain. According to a third downmix conversion method, a discrete frequency domain is converted to the time domain and then, the converted time domain is converted into the rendering domain in case that the downmix domain is a discrete frequency domain.

The rendering part 220 performs pseudo-surround rendering for a downmix signal using surround converting information to generate a pseudo-surround signal. Here, the pseudo-surround signal output from the pseudo-surround decoding part 180 with the stereo output channel becomes a pseudo-surround stereo output having virtual surround sound. Also, since the pseudo-surround signal outputted from the rendering part 220 is a signal in the rendering domain, domain conversion is needed when the rendering domain is not a time domain. Although the present invention is described in case that the output channel of the pseudo-surround decoding part 180 is the stereo channel, it will be easily appreciated that the present invention can be applied, regardless of the number of the output channel.

For example, a pseudo-surround rendering method may be implemented by HRTF filtering method, in which input signal undergoes a set of HRTF filters. Here, spatial information may be a value which can be used in a hybrid filterbank domain which is defined in MPEG surround. The pseudo-surround rendering method can be implemented as the following embodiments, according to types of downmix domain and spatial information domain. To this end, the downmix domain_and the spatial information domain are made to be coincident with the rendering domain.

According to an embodiment of pseudo-surround rendering method, there is a method in which pseudo-surround rendering for a downmix signal is performed in a subband domain (QMF). The subband domain includes a simple subband domain and a hybrid domain. For example, when the downmix signal is a PCM signal and the downmix domain is not a subband domain, the rendering domain converting part 210 converts the downmix domain into the subband domain. On the other hand, when the downmix domain is subband domain, the downmix domain does not need to be converted. In some cases, in order to synchronize the downmix signal with the spatial information, there is need to delay either the downmix signal or the spatial information. Here, when the spatial information domain is a subband domain, the spatial information domain does not need to be converted. Also, in order to generate a pseudo-surround signal in the time domain, the output domain converting part 230 converts the rendering domain into time domain.

According to another embodiment of the pseudo-surround rendering method, there is a method in which pseudo-surround rendering for a downmix signal is performed in a discrete frequency domain. Here, the discrete frequency domain is indicative of a frequency domain except for a subband domain. That is, the frequency domain may include at least one of the discrete frequency domain and the subband domain. For example, when the downmix domain is not a discrete frequency domain, the rendering domain converting part 210 converts the downmix domain into the discrete frequency domain. Here, when the spatial information domain is a subband domain, the spatial information domain needs to be converted to a discrete frequency domain. The method serves to replace filtering in a time domain with operations in a discrete frequency domain, such that operation speed may be relatively rapidly performed. Also, in order to generate a pseudo-surround signal in a time domain, the output domain converting part 230 may convert the rendering domain into time domain.

According to still another embodiment of the pseudo-surround rendering method, there is a method in which pseudo-surround rendering for a downmix signal is performed in a time domain. For example, when the downmix domain is not a time domain, the rendering domain converting part 210 converts the downmix domain into the time domain. Here, when spatial information domain is a subband domain, the spatial information domain is also converted into the time domain. In this case, since the rendering domain is a time domain, the output domain converting part 230 does not need to convert the rendering domain into time domain.

Figure 3:
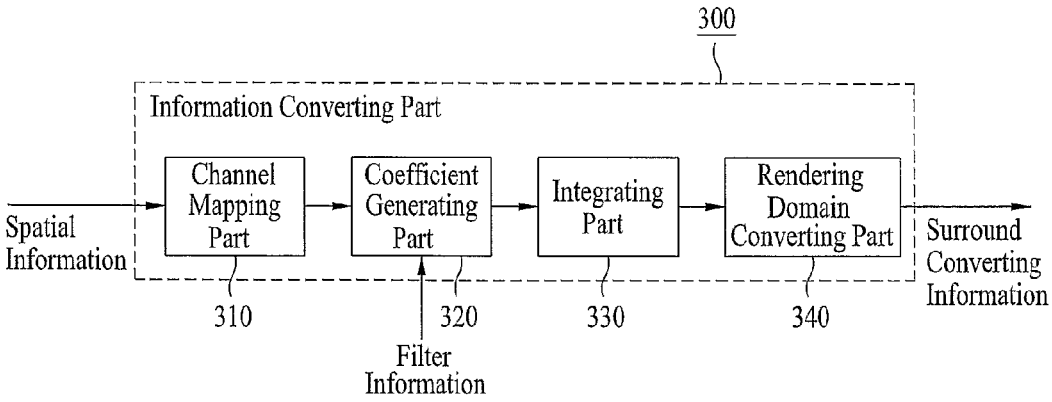
FIG. 3 illustrates a schematic block diagram of an information converting part according to an embodiment of the present invention.

FIG. 3 illustrates a schematic block diagram of an information converting part 300 according to an embodiment of the present invention. As shown in FIG. 3, the information converting part 300 includes a channel mapping part 310, a coefficient generating part 320, and an integrating part 330. Also, the information converting part 300 may further include an additional processing part (not shown) for additionally processing filter coefficients and/or a rendering domain converting part 340.

The channel mapping part 310 performs channel mapping such that the inputted spatial information may be mapped to at least one channel signal of multi-channel signals, and then generates channel mapping output values as channel mapping information.

The coefficient generating part 320 generates channel coefficient information. The channel coefficient information may include coefficient information by channels or interchannel coefficient information. Here, the coefficient information by channels is indicative of at least one of size information, and energy information, etc., and the interchannel coefficient information is indicative of interchannel correlation information which is calculated using a filter coefficient and a channel mapping output value. The coefficient generating part 320 may include a plurality of coefficient generating parts by channels. The coefficient generating part 320 generates the channel coefficient information using the filter information and the channel mapping output value. Here, the channel may include at least one of multi-channel, a downmix channel, and an output channel. From now, the channel will be described as the multi-channel, and the coefficient information by channels will be also described as size information. Although the channel and the coefficient information will be described on the basis of such embodiments, it will be easily appreciated that there are many possible modifications of the embodiments. Also, the coefficient generating part 320 may generate the channel coefficient information, according to the channel number or other characteristics.

The integrating part 330 receiving coefficient information by channels integrates or sums up the coefficient information by channels to generate integrating coefficient information. Also, the integrating part 330 generates filter coefficients using the integrating coefficients of the integrating coefficient information. The integrating part 330 may generate the integrating coefficients by further integrating additional information with the coefficients by channels. The integrating part 330 may integrate coefficients by at least one channel, according to characteristics of channel coefficient information. For example, the integrating part 330 may perform integrations by downmix channels, by output channels, by one channel combined with output channels, and by combination of the listed channels, according to characteristics of channel coefficient information. In addition, the integrating part 330 may generate additional process coefficient information by additionally processing the integrating coefficient. That is, the integrating part 330 may generate a filter coefficient by the additional process. For example, the integrating part 330 may generate filter coefficients by additionally processing the integrating coefficient such as by applying a particular function to the integrating coefficient or by combining a plurality of integrating coefficients. Here, the integration coefficient information is at least one of output channel magnitude information, output channel energy information, and output channel correlation information.

When a spatial information domain is different from a rendering domain, the rendering domain converting part 340 may coincide the spatial information domain with the rendering domain. The rendering domain converting part 340 may convert the domain of filter coefficients for the pseudo-surround rendering, into the rendering domain.

Since the integration part 330 plays to a role of reducing the operation amounts of pseudo-surround rendering, it may be omitted. Also, in case of a stereo downmix signal, a coefficient set to be applied to left and right downmix signals is generated, in generating coefficient information by channels. Here, a set of filter coefficients may include filter coefficients, which are transmitted from respective channels to their own channels, and filter coefficients, which are transmitted from respective channels to their opposite channels.

Figure 4:
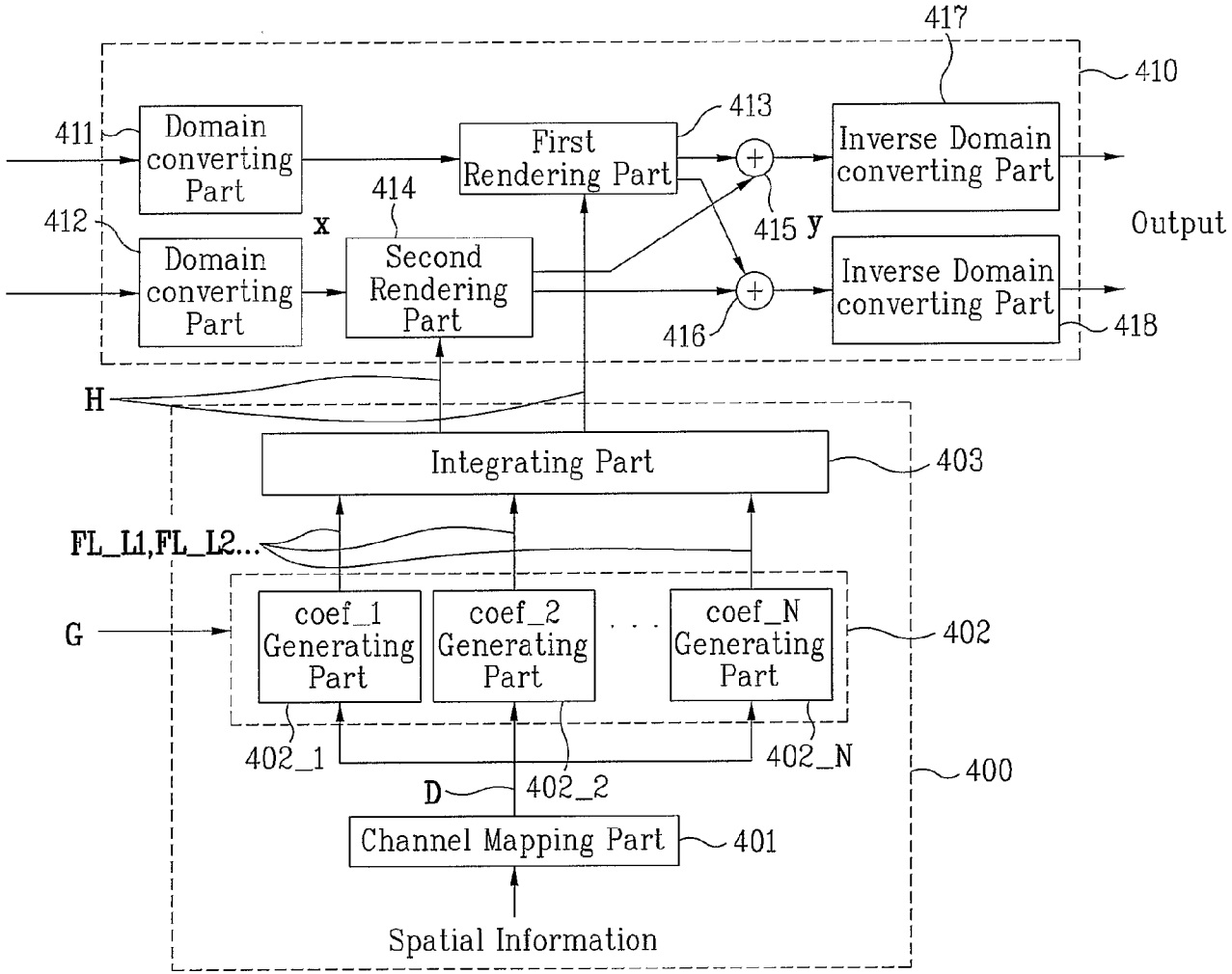
FIG. 4 illustrates a schematic block diagram for describing a pseudo-surround rendering procedure and a spatial information converting procedure, according to an embodiment of the present invention.

FIG. 4 illustrates a schematic block diagram for describing a pseudo-surround rendering procedure and a spatial information converting procedure, according to an embodiment of the present invention. Then, the embodiment illustrates a case where a decoded stereo downmix signal is received to a pseudo-surround generating part 410.

An information converting part 400 may generate a coefficient which is transmitted to its own channel in the pseudo-surround generating part 410, and a coefficient which is transmitted to an opposite channel in the pseudo-surround generating part 410. The information converting part 400 generates a coefficient HL_L and a coefficient HL_R, and output the generated coefficients HL_L and HL_R to a first rendering part 413. Here, the coefficient HL_L is transmitted to a left output side of the pseudo-surround generating part 410, and, the coefficient HL_R is transmitted to a right output side of the pseudo-surround generating part 410. Also, the information converting part 400 generates coefficients HR_R and HR_L, and output the generated coefficients HR_R and HR_L to a second rendering part 414. Here, the coefficient HR_R is transmitted to a right output side of the pseudo-surround generating part 410, and the coefficient HR_L is transmitted to a left output side of the pseudo-surround generating part 410.

The pseudo-surround generating part 410 includes the first rendering part 413, the second rendering part 414, and adders 415 and 416. Also, the pseudo-surround generating part 410 may further include domain converting parts 411 and 412 which coincide downmix domain with rendering domain, when two domains are different from each other, for example, when a downmix domain is not a subband domain, and a rendering domain is the subband domain. Here, the pseudo-surround generating part 410 may further include inverse domain converting parts 417 and 418 which covert a rendering domain, for example, subband domain to a time domain. Therefore, users can hear audio with a virtual multi-channel sound through ear phones having stereo channels, etc.

The first and second rendering parts 413 and 414 receive stereo downmix signals and a set of filter coefficients. The set of filter coefficients are applied to left and right downmix signals, respectively, and are outputted from an integrating part 403.

For example, the first and second rendering parts 413 and 414 perform rendering to generate pseudo-surround signals from a downmix signal using four filter coefficients, HL_L, HL_R, HR_L, and HR_R.

More specifically, the first rendering part 413 may perform rendering using the filter coefficient HL_L and HL_R, in which the filter coefficient HL_L is transmitted to its own channel, and the filter coefficient HL_R is transmitted to a channel opposite to its own channel. The first rendering part 413 may include sub-rendering parts (not shown) 1-1 and 1-2. Here, the sub-rendering part 1-1 performs rendering using a filter coefficient HL_L which is transmitted to a left output side of the pseudo-surround generating part 410, and the sub-rendering part 1-2 performs rendering using a filter coefficient HL_R which is transmitted to a right output side of the pseudo-surround generating part 410. Also, the second rendering part 414 performs rendering using the filter coefficient sets HR_R and HR_L, in which the filter coefficient HR_R is transmitted to its own channel, and the filter coefficient HR_L is transmitted to a channel opposite to its own channel. The second rendering part 414 may include sub-rendering parts (not shown) 2-1 and 2-2. Here, the sub-rendering part 2-1 performs rendering using a filter coefficient HR_R which is transmitted to a right output side of the pseudo-surround generating part 410, and the sub-rendering part 2-2 performs rendering using a filter coefficient HR_L which is transmitted to a left output side of the pseudo-surround generating part 410. The HL_R and HR_R are added in the adder 416, and the HL_L and HR_L are added in the adder 415. Here, as occasion demands, the HL_R and HR_L become zero, which means that a coefficient of cross terms be zero. Here, when the HL_R and HR_L are zero, two other passes do not affect each other.

On the other hand, in case of a mono downmix signal, rendering may be performed by an embodiment having structure similar to that of FIG. 4. More specifically, an original mono input is referred to as a first channel signal, and a signal obtained by decorrelating the first channel signal is referred as a second channel signal. In this case, the first and second rendering parts 413 and 414 may receive the first and second channel signals and perform renderings of them.

Referring to FIG. 4, it is defined that the inputted stereo downmix signal is denoted by "x", channel mapping coefficient, which is obtained by mapping spatial information to channel, is denoted by "D", a proto-type HRTF filter coefficient of an external input is denoted by "G", a temporary multi-channel signal is denoted by "p", and an output signal which has undergone rendering is denoted by "y". The notations "x", "D", "G", "p", and "y" may be expressed by a matrix form as following Equation 1. Equation 1 is expressed on the basis of the proto-type HRTF filter coefficient. However, when a modified HRTF filter coefficient is used in the following Equations, G must be replaced with G' in the following Equations.

$$x = \begin{bmatrix} Li \\ Ri \end{bmatrix}, \quad p = \begin{bmatrix} L \\ Ls \\ R \\ Rs \\ C \\ LFE \end{bmatrix}, \qquad \text{[Equation 1]}$$

-continued $$D = \begin{bmatrix} D_L1 & D_L2 \\ D_Ls1 & D_Ls2 \\ D_R1 & D_R2 \\ D_Rs1 & D_Rs2 \\ D_C1 & D_C2 \\ D_LFE1 & D_LFE2 \end{bmatrix},$$

$$G = \begin{bmatrix} GL_L & GLs_L & GR_L & GRs_L & GC_L & GLFE_L \\ GL_R & GLs_R & GR_R & GRs_R & GC_R & GLFE_R \end{bmatrix}$$

$$y = \begin{bmatrix} Lo \\ Ro \end{bmatrix}$$

Here, when each coefficient is a value of a frequency domain, the temporary multi-channel signal "p" may be expressed by the product of a channel mapping coefficient "D" by a stereo downmix signal "x" as the following Equation 2.

$$p = D \cdot x, \qquad \text{[Equation 2]}$$

$$\begin{bmatrix} L \\ Ls \\ R \\ Rs \\ C \\ LFE \end{bmatrix} = \begin{bmatrix} D_L1 & D_L2 \\ D_Ls1 & D_Ls2 \\ D_R1 & D_R2 \\ D_Rs1 & D_Rs2 \\ D_C1 & D_C2 \\ D_LFE1 & D_LFE2 \end{bmatrix} \begin{bmatrix} Li \\ Ri \end{bmatrix}$$

After that, the output signal "y" may be expressed by Equation 3, when rendering the temporary multi-channel "p" using the proto-type HRTF filter coefficient "G".

$$y = G \cdot p \qquad \text{[Equation 3]}$$

Then, "y" may be expressed by Equation 4 if p=D·X is inserted.

$$y = GDx \qquad \text{[Equation 4]}$$

Here, if H=GD is defined, the output signal "y" and the stereo downmix signal "x" have a relationship as following Equation 5.

$$H = \begin{bmatrix} HL_L & HR_L \\ HL_R & HR_R \end{bmatrix}, \quad y = Hx \qquad \text{[Equation 5]}$$

Therefore, the product of the filter coefficients allows "H" to be obtained. After that, the output signal "y" may be acquired by multiplying the stereo downmix signal "x" and the "H".

Coefficient F (FL_L1, FL_L2, . . . ), will be described later, may be obtained by following Equation 6.

$$H = GD \qquad \text{[Equation 6]}$$

$$= \begin{bmatrix} GL_L & GLs_L & GR_L & GRs_L & GC_L & GLFE_L \\ GL_R & GLs_R & GR_R & GRs_R & GC_R & GLFE_R \end{bmatrix}$$

-continued $$\begin{bmatrix} D_L1 & D_L2 \\ D_Ls1 & D_Ls2 \\ D_R1 & D_R2 \\ D_Rs1 & D_Rs2 \\ D_C1 & D_C2 \\ D_LFE1 & D_LFE2 \end{bmatrix}$$

Figure 5:
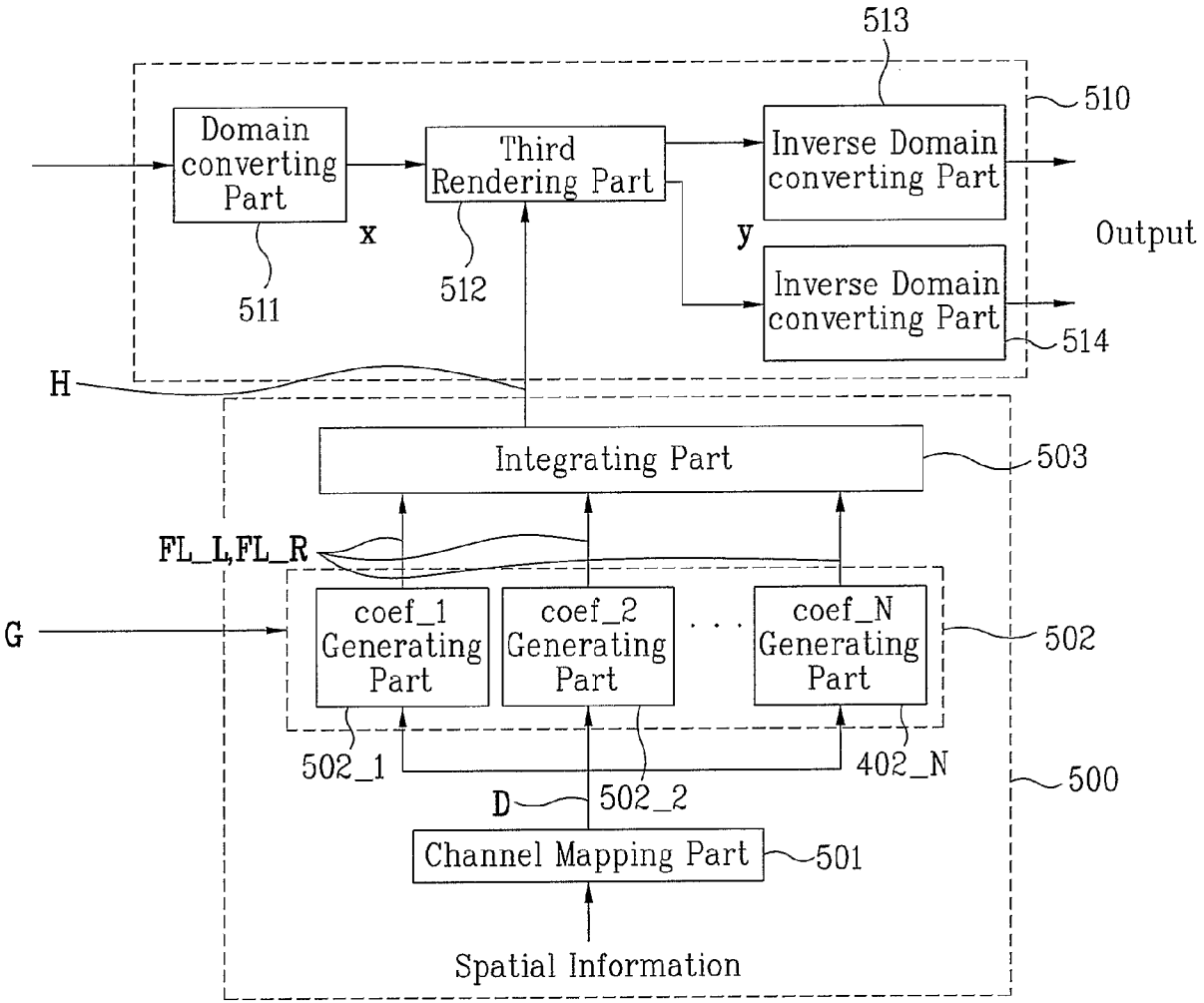
FIG. 5 illustrates a schematic block diagram for describing a pseudo-surround rendering procedure and a spatial information converting procedure, according to another embodiment of the present invention.

FIG. 5 illustrates a schematic block diagram for describing a pseudo-surround rendering procedure and a spatial information converting procedure, according to another embodiment of the present invention. Then, the embodiment illustrates a case where a decoded mono downmix signal is received to a pseudo-surround generating part 510. As shown in the drawing, an information converting part 500 includes a channel mapping part 501, a coefficient generating part 502, and an integrating part 503. Since such elements of the information converting part 500 perform the same functions as those of the information converting part 400 of FIG. 4, their detailed descriptions will be omitted below. Here, the information converting part 500 may generate a final filter coefficient whose domain is coincided to the rendering domain in which pseudo-surround rendering is performed. When the decoded downmix signal is a mono downmix signal, the filter coefficient set may include filter coefficient sets HM_L and HM_R. The filter coefficient HM_L is used to perform rendering of the mono downmix signal to output the rendering result to the left channel of the pseudo-surround generating part 510. The filter coefficient HM_R is used to perform rendering of the mono downmix signal to output the rendering result to the right channel of the pseudo-surround generating part 510.

The pseudo-surround generating part 510 includes a third rendering part 512. Also, the pseudo-surround generating part 510 may further include a domain converting part 511 and inverse domain converting parts 513 and 514. The elements of the pseudo-surround generating part 510 are different from those of the pseudo-surround generating part 410 of FIG. 4 in that, since the decoded downmix signal is a mono downmix signal in FIG. 5, the pseudo-surround generating part 510 includes one third rendering part 512 performing pseudo-surround rendering and one domain converting part 511. The third rendering part 512 receives a filter coefficient set HM_L and HM_R from the integrating part 503, and may perform pseudo-surround rendering of the mono downmix signal using the received filter coefficient, and generate a pseudo-surround signal.

Meanwhile, in a case where the downmix signal is a mono signal, an output of stereo downmix can be obtained by performing pseudo-surround rendering of mono downmix signal, according to the following two methods.

According to the first method, the third rendering part 512 (for example, a HRTF filter) does not use a filter coefficient for a pseudo-surround sound but uses a value used when processing stereo downmix. Here, the value used when processing the stereo downmix may be coefficients (left front=1, right front=0, . . . , etc.), where the coefficient "left front" is for left output, and the coefficient "right front" is for right output.

Second, in the middle of the decoding process of generating the multi-channel signal from the downmix signal using spatial information, the output of stereo downmix having a desired channel number is obtained.

Referring to FIG. 5, it is defined that the input mono downmix signal is denoted by "x", a channel mapping coefficient is denoted by "D", a proto-type HRTF filter coefficient of an external input is denoted by "G", a temporary multi-channel signal is denoted by "p", and an output signal which has undergone rendering is denoted by "y", the notations "x", "D", "G", "p", and "y" may be expressed by a matrix form as following Equation 7.

$$x = [Mi], \qquad \text{[Equation 7]}$$

$$p = \begin{bmatrix} L \\ Ls \\ R \\ Rs \\ C \\ LFE \end{bmatrix},$$

$$D = \begin{bmatrix} D_L \\ D_Ls \\ D_R \\ D_Rs \\ D_C \\ D_LFE \end{bmatrix}$$

$$G = \begin{bmatrix} GL_L & GLs_L & GR_L & GRs_L & GC_L & GLFE_L \\ GL_R & GLs_R & GR_R & GRs_R & GC_R & GLFE_R \end{bmatrix},$$

$$y = \begin{bmatrix} Lo \\ Ro \end{bmatrix}$$

The relationships between matrices in Equation 7 have already been described in the explanation of FIG. 4. Therefore, the following description will omit their descriptions. Here, FIG. 4 illustrates a case where the stereo downmix signal is received, and FIG. 5 illustrates a case where the mono downmix signal is received.

Figure 6:
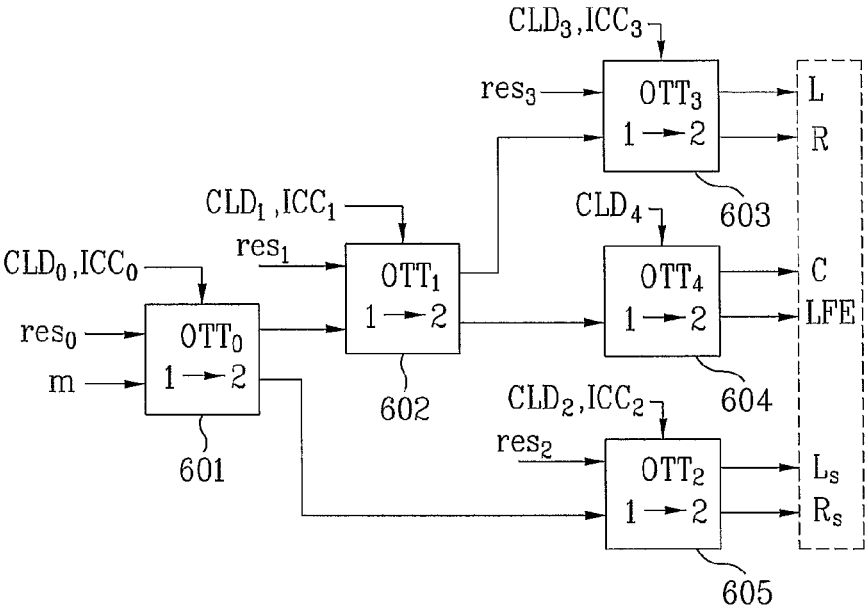
FIG. 6 and FIG. 7 illustrate schematic block diagrams for describing channel mapping procedures according to an embodiment of the present invention.
Figure 7:
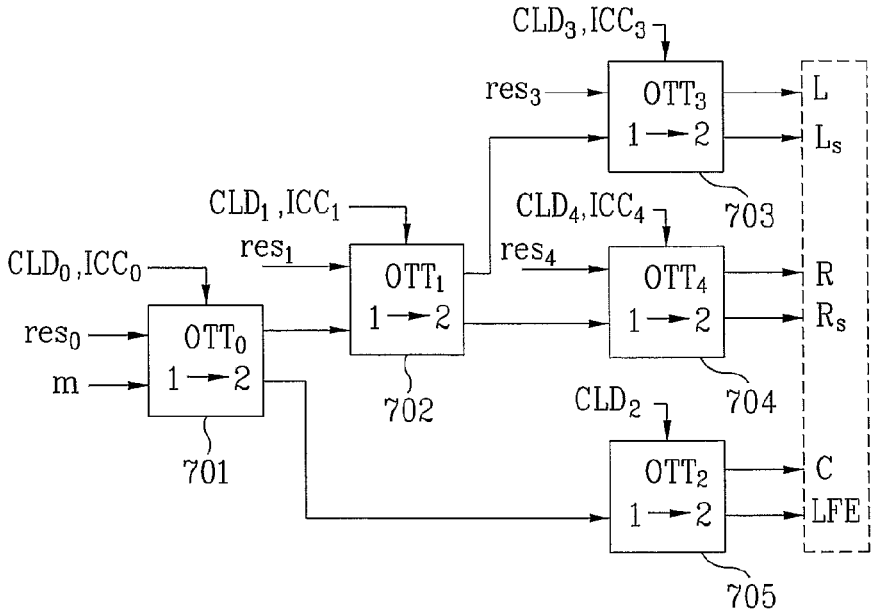

FIG. 6 and FIG. 7 illustrate schematic block diagrams for describing channel mapping procedures according to embodiments of the present invention. The channel mapping process means a process in which at least one of channel mapping output values is generated by mapping the received spatial information to at least one channel of multi channels, to be compatible with the pseudo-surround generating part. The channel mapping process is performed in the channel mapping parts 401 and 501. Here, spatial information, for example, energy, may be mapped to at least two of a plurality of channels. Here, an Lfe channel and a center channel C may not be splitted. In this case, since such a process does not need a channel splitting part 604 or 705, it may simplify calculations.

For example, when a mono downmix signal is received, channel mapping output values may be generated using coefficients, CLD1 through CLD5, ICC1 through ICC5, etc. The channel mapping output values may be $D_L$, $D_R$, $D_C$, $D_{LEF}$, $D_{LS}$, $D_{RS}$, etc. Since the channel mapping output values are obtained by using spatial information, various types of channel mapping output values may be obtained according to various formulas. Here, the generation of the channel mapping output values may be varied according to tree configuration of spatial information received by a decoding device 150, and a range of spatial information which is used in the decoding device 150.

FIGS. 6 and 7 illustrate schematic block diagrams for describing channel mapping structures according to an embodiment of the present invention. Here, a channel mapping structure may include at least one channel splitting part indicative of an OTT box. The channel structure of FIG. 6 has 5151 configuration.

Referring to FIG. 6, multi-channel signals L, R, C, LFE, Ls, Rs may be generated from the downmix signal "m", using the OTT boxes 601, 602, 603, 604, 605 and spatial information, for example, $CLD_0$, $CLD_1$, $CLD_2$, $CLD_3$, $CLD_4$, $ICC_0$, $ICC_1$, $ICC_2$, $ICC_3$, etc. For example, when the tree structure has 5151 configuration as shown in FIG. 6, the channel mapping output values may be obtained, using CLD only, as shown in Equation 8.

$$\begin{bmatrix} L \\ R \\ C \\ LFE \\ Ls \\ Rs \end{bmatrix} = \begin{bmatrix} D_L \\ D_R \\ D_C \\ D_{LFE} \\ D_{Ls} \\ D_{Rs} \end{bmatrix} m = \begin{bmatrix} c_{1,OTT3}c_{1,OTT1}c_{1,OTT0} \\ c_{2,OTT3}c_{1,OTT1}c_{1,OTT0} \\ c_{1,OTT4}c_{2,OTT1}c_{1,OTT0} \\ c_{2,OTT4}c_{2,OTT1}c_{1,OTT0} \\ c_{1,OTT2}c_{2,OTT0} \\ c_{2,OTT2}c_{2,OTT0} \end{bmatrix} m \quad \text{[Equation 8]}$$

Where, $$c_{1,OTT_s}^{l,m} = \sqrt{\frac{10^{\frac{CLD_N^{l,m}}{10}}}{1+10^{\frac{CLD_N^{l,m}}{10}}}},$$

$$c_{2,OTT_x}^{l,m} = \sqrt{\frac{1}{1+10^{\frac{CLD_N^{l,m}}{10}}}}$$

Referring to FIG. 7, multi-channel signals L, Ls, R, Rs, C, LFE may be generated from the downmix signal "m", using the OTT boxes 701, 702, 703, 704, 705 and spatial information, for example, $CLD_0$, $CLD_1$, $CLD_2$, $CLD_3$, $CLD_4$, $ICC_0$, $ICC_1$, $ICC_3$, $ICC_4$, etc.

For example, when the tree structure has 5152 configuration as shown in FIG. 7, the channel mapping output values may be obtained, using CLD only, as shown in Equation 9.

$$\begin{bmatrix} L \\ Ls \\ R \\ Rs \\ C \\ LFE \end{bmatrix} = \begin{bmatrix} D_L \\ D_{Ls} \\ D_R \\ D_{Rs} \\ D_C \\ D_{LFE} \end{bmatrix} m = \begin{bmatrix} c_{1,OTT3}c_{1,OTT1}c_{1,OTT0} \\ c_{2,OTT3}c_{1,OTT1}c_{1,OTT0} \\ c_{1,OTT4}c_{2,OTT1}c_{1,OTT0} \\ c_{2,OTT4}c_{2,OTT1}c_{1,OTT0} \\ c_{1,OTT2}c_{2,OTT0} \\ c_{2,OTT2}c_{2,OTT0} \end{bmatrix} m \quad \text{[Equation 9]}$$

The channel mapping output values may be varied, according to frequency bands, parameter bands and/or transmitted time slots. Here, if difference of channel mapping output value between adjacent bands or between time slots forming boundaries is enlarged, distortion may occur when performing pseudo-surround rendering. In order to prevent such distortion, blurring of the channel mapping output values in the frequency and time domains may be needed. More specifically, the method to prevent the distortion is as follows. Firstly, the method may employ frequency blurring and time blurring, or also any other technique which is suitable for pseudo-surround rendering. Also, the distortion may be prevented by multiplying each channel mapping output value by a particular gain.

Figure 8:
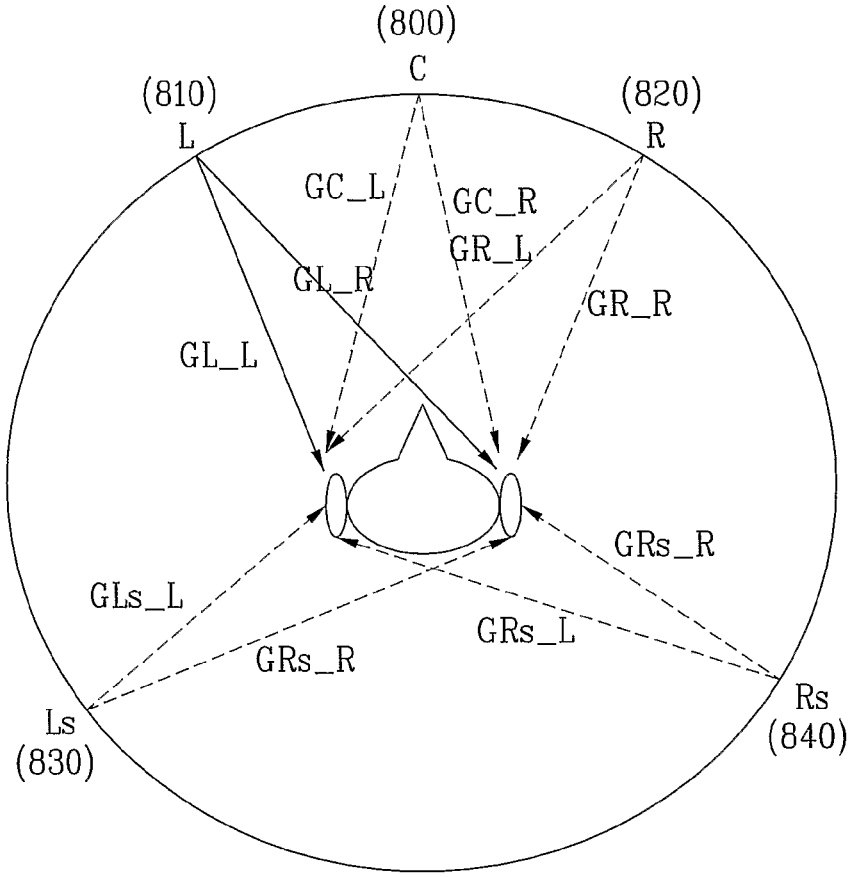

FIG. 8 illustrates a schematic view for describing filter coefficients by channels, according to an embodiment of the present invention. For example, the filter coefficient may be a HRTF coefficient.

In order to perform pseudo-surround rendering, a signal from a left channel source "L" 810 is filtered by a filter having a filter coefficient GL_L, and then the filtering result L*GL_L is transmitted as the left output. Also, a signal from the left channel source "L" 810 is filtered by a filter having a filter coefficient GL_R, and then the filtering result L*GL_R is transmitted as the right output. For example, the left and right outputs may attain to left and right ears of user, respectively. Like this, all left and right outputs are obtained by channels. Then, the obtained left outputs are summed to generate a final left output (for example, Lo), and the obtained right outputs are summed to generate a final right output (for example, Ro). Therefore, the final left and right outputs which have undergone pseudo-surround rendering may be expressed by following Equation 10.

Lo=*L**GL_L+*C**GC_L+*R**GR_L+Ls*GLs_L+Rs*GRs_L

Ro=L*GL_R+*C**GC_R+*R**GR_R+Ls*GLs_R+Rs*GRS_R [Equation 10]

According to an embodiment of the present invention, the method for obtaining L(810), C(800), R(820), Ls(830), and Rs(840) is as follows. First, L(810), C(800), R(820), Ls(830), and Rs(840) may be obtained by a decoding method for generating multi-channel signal using a downmix signal and spatial information. For example, the multi-channel signal may be generated by an MPEG surround decoding method. Second, L(810), C(800), R(820), Ls(830), and Rs(840) may be obtained by equations related to only spatial information.

Figure 9:
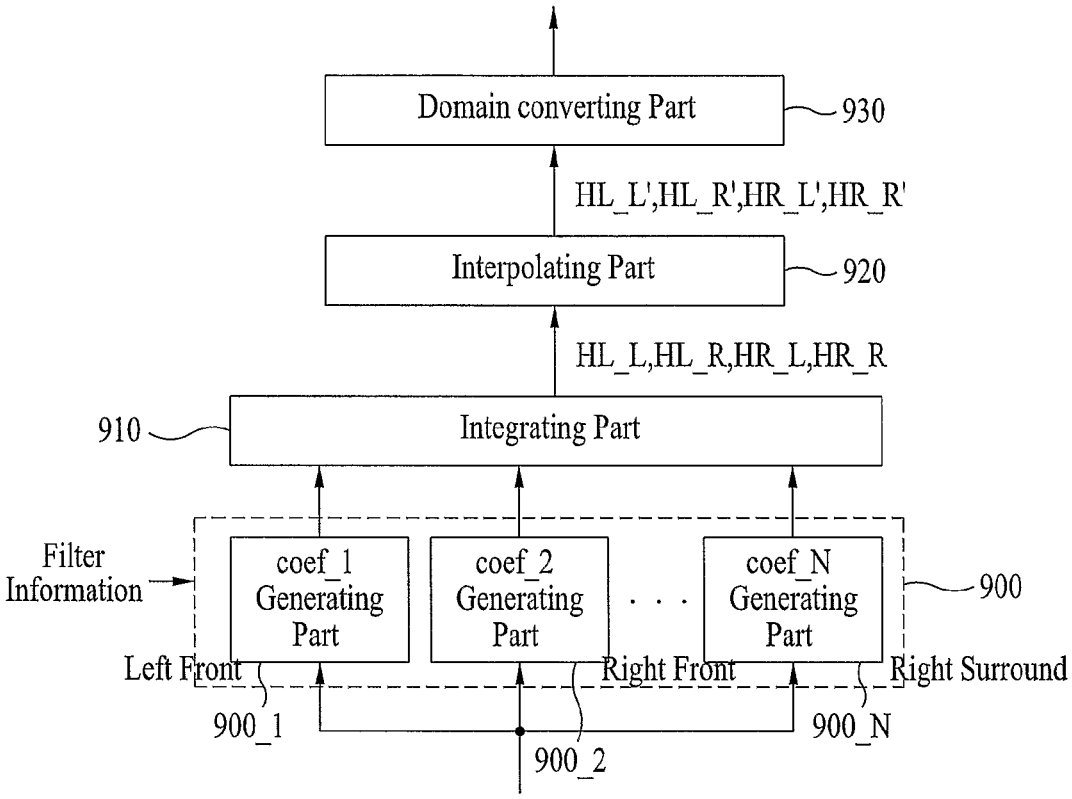
FIG. 9 through FIG. 11 illustrate schematic block diagrams for describing procedures for generating surround converting information according to embodiments of the present invention.
Figure 10:
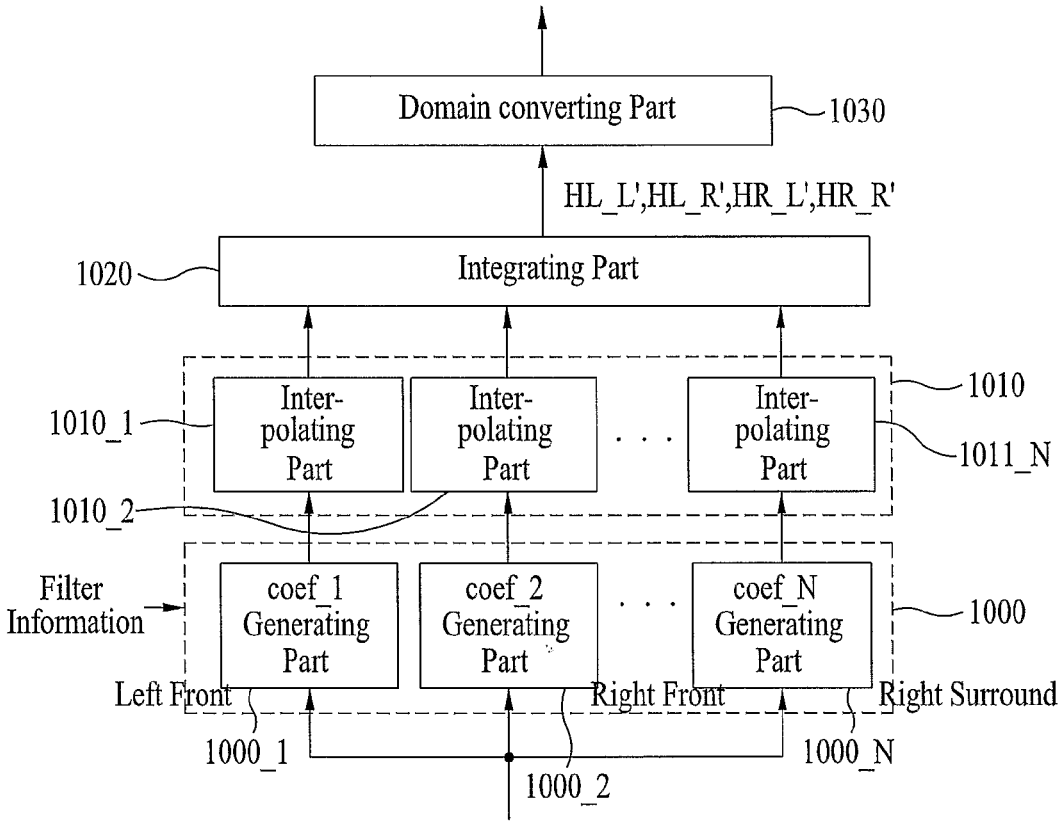
Figure 11:
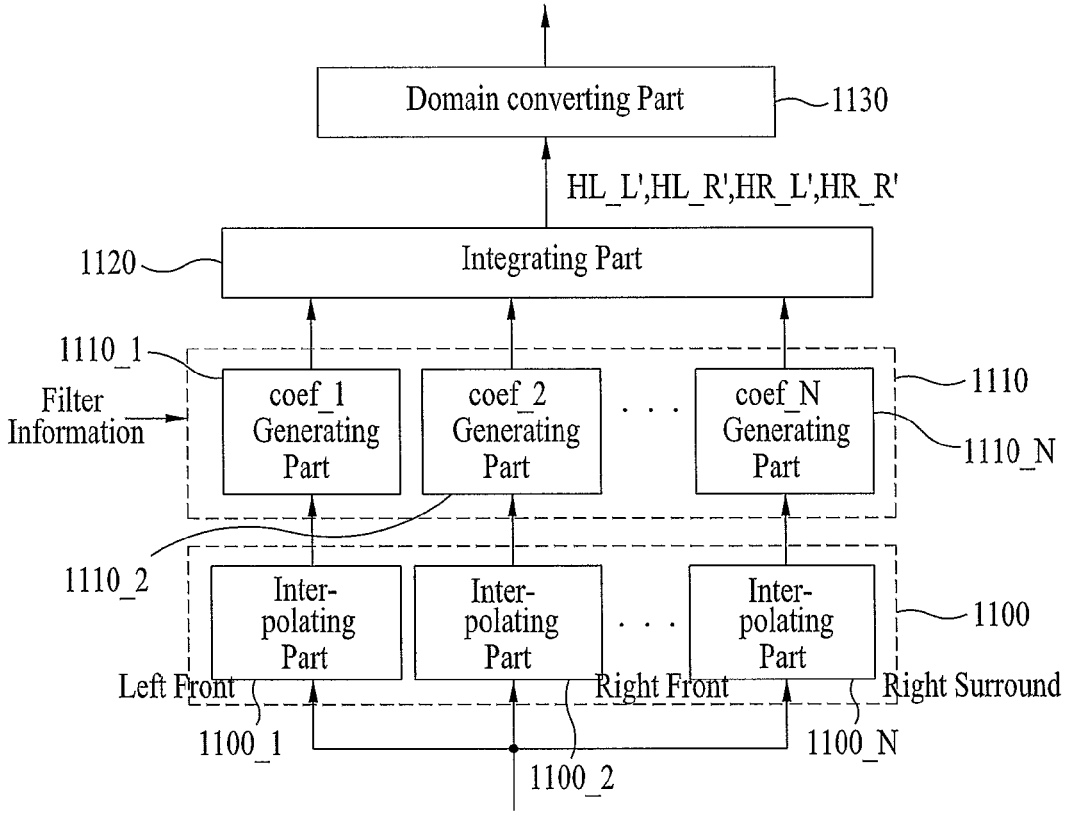

FIG. 9 through FIG. 11 illustrate schematic block diagrams for describing procedures for generating surround converting information, according to embodiments of the present invention.

FIG. 9 illustrates a schematic block diagram for describing procedures for generating surround converting information according to an embodiment of the present invention. As shown in FIG. 9, an information converting part, except for a channel mapping part, may include a coefficient generating part 900 and an integrating part 910. Here, the coefficient generating part 900 includes at least one of sub coefficient generating parts (coef_1 generating part 900_1, coef_2 generating part 900_2, . . . , coef_N generating part 900_N). Here, the information converting part may further include an interpolating part 920 and a domain converting part 930 so as to additionally processing filter coefficients.

The coefficient generating part 900 generates coefficients, using spatial information and filter information. The following is a description for the coefficient generation in a particular sub coefficient generating part for example, coef_1 generating part 900_1, which is referred to as a first sub coefficient generating part.

For example, when a mono downmix signal is input, the first sub coefficient generating part 900_1 generates coefficients FL_L and FL_R for a left channel of the multi channels, using a value D_L which is generated from spatial information. The generated coefficients FL_L and FL_R may be expressed by following Equation 11.

FL_L=D_L*GL_L (a coefficient used for generating the left output from input mono downmix signal)

FL_R=D_L*GL_R (a coefficient used for generating the right output from input mono channel signal) [Equation 11]

Here, the D_L is a channel mapping output value generated from the spatial information in the channel mapping process. Processes for obtaining the D_L may be varied, according to tree configuration information which an encoding device transmits and a decoding device receives. Similarly, in case the coef_2 generating part 900_2 is referred to as a second sub coefficient generating part and the coef_3 generating part 900_3 is referred to as a third sub coefficient generating part, the second sub coefficient generating part 900_2 may generate coefficients FR_L and FR_R, and the third sub coefficient generating part 900_3 may generate FC_L and FC_R, etc.

For example, when the stereo downmix signal is input, the first sub coefficient generating part 900_1 generates coefficients FL_L1, FL_L2, FL_R1, and FL_R2 for a left channel of the multi channel, using values D_L1 and D_L2 which are generated from spatial information. The generated coefficients FL_L1, FL_L2, FL_R1, and FL_R2 may be expressed by following Equation 12.

FL_L1=D_L1*GL_L (a coefficient used for generating the left output from a left downmix signal of the input stereo downmix signal)

FL_L2=D_L2*GL_L (a coefficient used for generating the left output from a right downmix signal of the input stereo downmix signal)

FL_R1=D_L1*GL_R (a coefficient used for generating the right output from a left downmix signal of the input stereo downmix signal)

FL_R2=D_L2*GL_R (a coefficient used for generating the right output from a right downmix signal of the input stereo downmix signal) [Equation 12]

Here, similar to the case where the mono downmix signal is input, a plurality of coefficients may be generated by at least one of coefficient generating parts 900_1 through 900_N when the stereo downmix signal is input.

The integrating part 910 generates filter coefficients by integrating coefficients, which are generated by channels. The integration of the integrating part 910 for the cases that mono and stereo downmix signals are input may be expressed by following Equation 13.

In case the mono downmix signal is input:

HM_L=FL_L+FR_L+FC_L+FLS_L+FRS_L+FLFE_L

HM_R=FL_R+FR_R+FC_R+FLS_R+FRS_R+FLFE_R [Equation 13]

In case of the stereo downmix signal is input:

HL_L=FL_L1+FR_L1+FC_L1+FLS_L1+FRS_L1+FLFE_L1

HR_L=FL_L2+FR_L2+FC_L2+FLS_L2+FRS_L2+FLFE_L2

HL_R=FL_R1+FR_R1+FC_R1+FLS_R1+FRS_R1+FLFE_R1

HR_R=FL_R2+FR_R2+FC_R2+FLS_R2+FRS_R2+FLFE_R2

Here, the HM_L and HM_R are indicative of filter coefficients for pseudo-surround rendering in case the mono downmix signal is input. On the other hand, the HL_L, HR_L, HL_R, and HR_R are indicative of filter coefficients for pseudo-surround rendering in case the stereo downmix signal is input.

The interpolating part 920 may interpolate the filter coefficients. Also, time blurring of filter coefficients may be performed as post processing. The time blurring may be performed in a time blurring part (not shown). When transmitted and generated spatial information has wide interval in time axis, the interpolating part 920 interpolates the filter coefficients to obtain spatial information which does not exist between the transmitted and generated spatial information. For example, when spatial information exists in n-th parameter slot and n+K-th parameter slot (K>1), an embodiment of linear interpolation may be expressed by following Equation 14. In the embodiment of Equation 14, spatial information in a parameter slot which was not transmitted may be obtained using the generated filter coefficients, for example, HL_L, HR_L, HL_R and HR_R. It will be appreciated that the interpolating part 920 may interpolate the filter coefficients by various ways.

In case the mono downmix signal is input:

$$HM_L(n+j)=HM_L(n)*a+HM_L(n+k)*(1-a)$$

$$HM_R(n+j)=HM_R(n)*a+HM_R(n+k)*(1-a) \quad \text{[Equation 14]}$$

In case the stereo downmix signal is input:

$$HL_L(n+j)=HL_L(n)*a+HL_L(n+k)*(1-a)$$

$$HR_L(n+j)=HR_L(n)*a+HR_L(n+k)*(1-a)$$

$$HL_R(n+j)=HL_R(n)*a+HL_R(n+k)*(1-a)$$

$$HR_R(n+j)=HR_R(n)*a+HR_R(n+k)*(1-a)$$

Here, HM_L(n+j) and HM_R(n+j) are indicative of coefficients obtained by interpolating filter coefficient for pseudo-surround rendering, when a mono downmix signal is input. Also, HL_L(n+j), HR_L(n+j), HL_R(n+j) and HR_R(n+j) are indicative of coefficients obtained by interpolating filter coefficient for pseudo-surround rendering, when a stereo downmix signal is input. Here, 'j' and 'k' are integers, 0<j<k. Also, 'a' is a real number (0<a<1) and expressed by following Equation 15.

$$a=j/k \quad \text{[Equation 15]}$$

By the linear interpolation of Equation 14, spatial information in a parameter slot, which was not transmitted, between n-th and n+K-th parameter slots may be obtained using spatial information in the n-th and n+K-th parameter slots. Namely, the unknown value of spatial information may be obtained on a straight line formed by connecting values of spatial information in two parameter slots, according to Equation 15.

Discontinuous point can be generated when the coefficient values between adjacent blocks in a time domain are rapidly changed. Then, time blurring may be performed by the time blurring part to prevent distortion caused by the discontinuous point. The time blurring operation may be performed in parallel with the interpolation operation. Also, the time blurring and interpolation operations may be differently processed according to their operation order.

In case of the mono downmix channel, the time blurring of filter coefficients may be expressed by following Equation 16.

$$HM_L(n)'=HM_L(n)*b+HM_L(n-1)'*(1-b)$$

$$HM_R(n)'=HM_R(n)*b+HM_R(n-1)'*(1-b) \quad \text{[Equation 16]}$$

Equation 16 describes blurring through a 1-pole IIR filter, in which the blurring results may be obtained, as follows. That is, the filter coefficients HM_L(n) and HM_R(n) in the present block (n) are multiplied by "b", respectively. And then, the filter coefficients HM_L(n−1)' and HM_R(n−1)' in the previous block (n−1) are multiplied by (1−b), respectively. The multiplying results are added as shown in Equation 16. Here, "b" is a constant (0<b<1). The smaller the value of "b" the more the blurring effect is increased. On the contrary, the larger the value of "b", the less the blurring effect is increased. Similar to the above methods, the blurring of remaining filter coefficients may be performed.

Using the Equation 16 for time blurring, interpolation and blurring may be expressed by an Equation 17.

$$HM_L(n+j)'=(HM_L(n)*a+HM_L(n+k)*(1-a))*b+HM_L(n+j-1)'*(1-b)$$

$$HM_R(n+j)'=(HM_R(n)*a+HM_R(n+k)*(1-a))+b+HM_R(n+j-1)'*(1-b) \quad \text{[Equation 17]}$$

On the other hand, when the interpolation part 920 and/or the time blurring part perform interpolation and time blurring, respectively, a filter coefficient whose energy value is different from that of the original filter coefficient may be obtained. In that case, an energy normalization process may be further required to prevent such a problem. When a rendering domain does not coincide with a spatial information domain, the domain converting part 930 converts the spatial information domain into the rendering domain. However, if the rendering domain coincides with the spatial information domain, such domain conversion is not needed. Here, when a spatial information domain is a subband domain and a rendering domain is a frequency domain, such domain conversion may involve processes in which coefficients are extended or reduced to comply with a range of frequency and a range of time for each subband.

FIG. 10 illustrates a schematic block diagram for describing procedures for generating surround converting information according to another embodiment of the present invention. As shown in FIG. 10, an information converting part, except for a channel mapping part, may include a coefficient generating part 1000 and an integrating part 1020. Here, the coefficient generating part 1000 includes at least one of sub coefficient generating parts (coef_1 generating part 1000_1, coef_2 generating part 1000_2, and coef_N generating part 1000_N). Also, the information converting part may further include an interpolating part 1010 and a domain converting part 1030 so as to additionally process filter coefficients. Here, the interpolating part 1010 includes at least one of sub interpolating parts 1010_1, 1010_2, . . . , and 1010_N. Unlike the embodiment of FIG. 9, in the embodiment of FIG. 10 the interpolating part 1010 interpolates respective coefficients which the coefficient generating part 1000 generates by channels. For example, the coefficient generating part 1000 generates coefficients FL_L and FL_R in case of a mono downmix channel and coefficients FL_L1, FL_L2, FL_R1 and FL_R2 in case of a stereo downmix channel.

FIG. 11 illustrates a schematic block diagram for describing procedures for generating surround converting information according to still another embodiment of the present invention. Unlike embodiments of FIGS. 9 and 10, in the embodiment of FIG. 11 an interpolating part 1100 interpolates respective channel mapping output values, and then coefficient generating part 1110 generates coefficients by channels using the interpolation results.

In the embodiments of FIG. 9 through FIG. 11, it is described that the processes such as filter coefficient generation are performed in frequency domain, since channel mapping output values are in the frequency domain (for example, a parameter band unit has a single value). Also, when pseudo-surround rendering is performed in a subband domain, the domain converting part 930 or 1030 does not perform domain conversion, but bypasses filter coefficients of the subband domain, or may perform conversion to adjust frequency resolution, and then output the conversion result.

As described above, the present invention may provide an audio signal having a pseudo-surround sound in a decoding apparatus, which receives an audio bitstream including downmix signal and spatial information of the multi-channel signal, even in environments where the decoding apparatus cannot generate the multi-channel signal.

It will be apparent to those skilled in the art that various modifications and variations may be made in the present invention without departing from the spirit or scope of the invention. Thus, it is intended that the present invention cover the modifications and variations of this invention provided they come within the scope of the appended claims and their equivalents.

What is claimed is:

1. A method for decoding an audio signal, the method comprising:

receiving a downmix signal and spatial information;

generating surround converting information using the spatial information and filter information for a surround effect, wherein the downmix signal is stereo downmix signal which includes a left channel and a right channel, and wherein the surround converting information includes:

first converting information for processing a first part of a left output signal by being applied to the left channel, second converting information for processing a first part of a right output signal by being applied to the right channel, third converting information for processing a second part of the right output signal by being applied to the left channel, and fourth converting information for processing a second part of the left output signal by being applied to the right channel; and rendering the downmix signal to generate a pseudo-surround signal in a rendering domain, using the surround converting information.

2. The method of claim 1, further comprising converting the pseudo-surround signal of the rendering domain to a pseudo-surround signal of an output domain.

3. The method of claim 1, wherein:

the rendering domain includes at least one of frequency domain and time domain;

the frequency domain includes at least one of subband domain and discrete frequency domain; and the subband domain includes at least one of simple subband domain and hybrid subband domain.

4. The method of claim 1, further comprising:

converting the downmix signal of a downmix domain to the downmix signal of the rendering domain when the downmix domain is different from the rendering domain.

5. The method of claim 4, wherein the converting the downmix signal of the downmix domain comprises at least one of the operations:

converting the downmix signal of a time domain into the downmix signal of the rendering domain when the downmix domain is the time domain;

converting the downmix signal of a discrete frequency domain into the downmix signal of the rendering domain when the downmix domain is the discrete frequency domain; and converting the downmix signal of the discrete frequency domain into the downmix signal of the time domain, and then the downmix signal of the converted time domain into the downmix signal of the rendering domain, when the downmix domain is the discrete frequency domain.

6. The method of claim 1, wherein the rendering domain is a subband domain and the downmix signal comprises a first signal and a second signal, and the rendering of the downmix signal comprises:

applying the surround converting information to the first signal;

applying the surround converting information to the second signal; and, adding the first signal to the second signal.

7. The method of claim 1, wherein the generating of the surround converting information comprises:

generating channel mapping information by mapping the spatial information by channels;

generating the surround converting information using the channel mapping information and a filter information.

8. The method of claim 1, wherein the generating of the surround converting information comprises:

generating channel coefficient information using the spatial information and filter information; and, generating the surround converting information using the channel coefficient information.

9. The method of claim 1, wherein the generating of the surround converting information comprises:

generating channel mapping information by mapping the spatial information by channels;

generating channel coefficient information using the channel mapping information and filter information; and generating the surround converting information using the channel coefficient information.

10. The method of claim 1, further comprising:

receiving the audio signal including the downmix signal and the spatial information, wherein the downmix signal and the spatial information are extracted from the audio signal.

11. The method of claim 1, wherein the spatial information includes at least one of a channel level difference and an inter channel coherence.

12. A data structure of an audio signal, the data structure comprising:

a downmix signal which is generated by downmixing the audio signal having a plurality of channels; and spatial information which is generated while the downmix signal is generated, wherein the spatial information is converted to surround converting information, and the downmix signal is rendered to be converted to a pseudo-surround signal with the surround converting information being used, in a rendering domain, wherein the downmix signal is stereo downmix signal which includes a left channel and a right channel, and wherein the surround converting information includes:

first converting information for processing a first part of a left output signal by being applied to the left channel, second converting information for processing a first part of a right output signal by being applied to the right channel, third converting information for processing a second part of the right output signal by being applied to the left channel, and fourth converting information for processing a second part of the left output signal by being applied to the right channel.

13. A medium storing audio signals and having a data structure, wherein the data structure comprises:

a downmix signal which is generated by downmixing the audio signal having a plurality of channels; and spatial information which is generated while the downmix signal is generated, wherein the spatial information is converted to surround converting information, and the downmix signal is rendered to be converted to a pseudo-surround signal with the surround converting information being used, in a rendering domain, wherein the downmix signal is stereo downmix signal which includes a left channel and a right channel, and wherein the surround converting information includes:

first converting information for processing a first part of a left output signal by being applied to the left channel, second converting information for processing a first part of a right output signal by being applied to the right channel, third converting information for processing a second part of the right output signal by being applied to the left channel, and fourth converting information for processing a second part of the left output signal by being applied to the right channel.

14. An apparatus for decoding an audio signal, the apparatus comprising:

a demultiplexing part receiving a downmix signal and spatial information;

an information converting part generating surround converting information using the spatial information and filter information for a surround effect; and a pseudo-surround generating part rendering the downmix signal to generate a pseudo-surround signal in a rendering domain, using the surround converting information, wherein the downmix signal is stereo downmix signal which includes a left channel and a right channel, and wherein the surround converting information includes:

first converting information for processing a first part of a left output signal by being applied to the left channel, second converting information for processing a first part of a right output signal by being applied to the right channel, third converting information for processing a second part of the right output signal by being applied to the left channel, and fourth converting information for processing a second part of the left output signal by being applied to the right channel.

15. The apparatus of claim 14, wherein the pseudo-surround generating part comprises an output domain converting part converting the pseudo-surround signal of the rendering domain to a pseudo-surround signal of an output domain.

16. The apparatus of claim 14, wherein:

the rendering domain includes at least one of frequency domain and time domain;

the frequency domain includes at least one of subband domain and discrete frequency domain; and the subband domain includes at least one of simple subband domain and hybrid subband domain.

17. The apparatus of claim 14, wherein the pseudo-surround generating part comprises:

a rendering domain converting part converting the downmix signal of a downmix domain to the downmix signal of the rendering domain when the downmix domain is different from the rendering domain.

18. The apparatus of claim 17 wherein the rendering domain converting part comprises at least one of:

a first domain converting part converting the downmix signal of a time domain into the downmix signal of the rendering domain when the downmix domain is the time domain;

a second domain converting part converting the downmix signal of a discrete frequency domain into the downmix signal of the rendering domain when the downmix domain is the discrete frequency domain; and a third domain converting part converting the downmix signal of the discrete frequency domain into the downmix signal of the time domain, and then the downmix signal of the converted time domain into the downmix signal of the rendering domain, when the downmix domain is the discrete frequency domain.

19. The apparatus of claim 14, wherein the rendering domain is a subband domain and the downmix signal comprises a first signal and a second signal, and the pseudo-surround generating part applies the surround converting information to the first signal, applies the surround converting information to the second signal; and, adding the first signal to the second signal.

20. The apparatus of claim 14, wherein the information converting part generates channel mapping information by mapping the spatial information by channels, and generates the surround converting information using the channel mapping information and a filter information.

21. The apparatus of claim 14, wherein the information converting part generates channel coefficient information using the spatial information and filter information, and generates the surround converting information using the channel coefficient information.

22. The apparatus of claim 14, wherein the information converting part comprises:

a channel mapping part generating channel mapping information by mapping the spatial information by channels;

a coefficient generating part generating channel coefficient information from the channel mapping information and filter information; and, an integrating part generating the surround converting information from the channel coefficient information.

23. The apparatus of claim 14, wherein the demultiplexing part receives the audio signal including the downmix signal and the spatial information, wherein the downmix signal and the spatial information are extracted from the audio signal.

24. The apparatus of claim 14, wherein the spatial information includes at least one of a channel level difference and an inter channel coherence.

25. The method of claim 1, further comprising:

Interpolating the surround converting information by using neighbor surround converting information of the surround converting information.

* * * * *